US009422070B2

(12) United States Patent
Neimark

(10) Patent No.: US 9,422,070 B2
(45) Date of Patent: Aug. 23, 2016

(54) DEVICE FOR CONTROLLED METERING AND MIXING OF SEVERAL ACTIVE LIQUIDS

(75) Inventor: Jean Neimark, Strasbourg (FR)

(73) Assignee: ASSISTANCE ET SERVICE SPECIALISE EN INNOVATION SCIENTIFIQUE ET TECHNIQUE (SOCIETE A RESPONSABILITE LIMITEE), Strasbourg (FR)

( * ) Notice: Subject to any disclaimer, the term of this patent is extended or adjusted under 35 U.S.C. 154(b) by 952 days.

(21) Appl. No.: 13/883,884

(22) PCT Filed: Mar. 10, 2011

(86) PCT No.: PCT/FR2011/050486

§ 371 (c)(1),
(2), (4) Date: Sep. 4, 2013

(87) PCT Pub. No.: WO2011/114041

PCT Pub. Date: Sep. 22, 2011

(65) Prior Publication Data

US 2013/0340889 A1 Dec. 26, 2013

(30) Foreign Application Priority Data

Mar. 17, 2010 (FR) ..... 10 51898
Aug. 13, 2010 (FR) ..... 10 56586

(51) Int. Cl.

| | |
|---|---|
| ***B65B 3/30*** | (2006.01) |
| ***B01F 13/10*** | (2006.01) |
| ***B01F 15/00*** | (2006.01) |
| ***B01F 15/04*** | (2006.01) |

(52) U.S. Cl.

CPC ..... *B65B 3/30* (2013.01); *B01F 13/1055* (2013.01); *B01F 15/00155* (2013.01); *B01F 15/0445* (2013.01); *B01F 2215/0055* (2013.01)

(58) Field of Classification Search

CPC ..... B65B 3/30
USPC ..... 366/163.1, 182.4
See application file for complete search history.

(56) References Cited

U.S. PATENT DOCUMENTS

| | | | | |
|---|---|---|---|---|
| 7,059,480 | B2 * | 6/2006 | Seshimoto | B01L 3/0275 210/321.67 |
| 2003/0004229 | A1 | 1/2003 | Schermacher et al. | |
| 2006/0209625 | A1 | 9/2006 | Jang et al. | |
| 2008/0305241 | A1 | 12/2008 | Trevino, III et al. | |

FOREIGN PATENT DOCUMENTS

EP 0 443 741 A1 8/1991

OTHER PUBLICATIONS

International Search Report, dated May 23, 2011, from corresponding PCT application.

* cited by examiner

*Primary Examiner* — David Sorkin
(74) *Attorney, Agent, or Firm* — Young & Thompson

(57) ABSTRACT

An automatic or semiautomatic device for the controlled metering and mixing of a plurality of active liquid substances for plants, includes elements for selectively sampling the substances in corresponding containers and moreover includes a fluid transfer element and, elements for metering, mixing, and diluting the sampled or transferred amounts of the liquid substance(s). The device also includes a controlling and managing unit that controls the sampling and transferring element and is associated with measurement elements and an element for controlling the flow of fluids within the valve-type device. The measurement elements include an element, advantageous for sequential use, for measuring a basic volume of a sampled concentrated liquid substance, the volume needing to be mixed and/or diluted. The measurement elements moreover include an element for continuously measuring the final volume of the metered solution obtained by diluting, after metering, the concentrated liquid substance or the mixture of concentrated liquid substances.

24 Claims, 14 Drawing Sheets

Product A
Product B
Product C
Product D
Washing
Rinsing
6-Valve Block
Water Valve
Fast-Moving Water
Outlets for Stirring Products by Air Bubbling
Air
V1b Vph
V2b Vpg
V3b Vpf
V4b Vpe
V1 Vpa
V2 Vpb
V3 Vpc
V4 Vpd
V5 Vlav
V6 Air
V7
V8
V9
1
2
2'
3
3'
4
5
7
8
9
10
14
15'
18
19
19'
19"
20
20'
21
22
23

Product A
Product B
Product C
Product D
Washing of Circuit + Volumeter
Waste
Fast-Moving Water
Water Valve
Outlets for Stirring Products by Air Bubbling
Air
V1b Vpn
V2b Vpg
V3b Vpf
V4b Vpe
V1 Vpa
V2 Vpb
V3 Vpc
V4 Vpd
V5 Vlav
V6 purge
V7
V9
no
nf
air

DEVICE FOR CONTROLLED METERING AND MIXING OF SEVERAL ACTIVE LIQUIDS

This invention relates to the field of domestic and even professional equipment for metering liquid mixtures, in particular liquids for plants, vegetables, and, more generally, horticultural use, and it has as its object a device for controlled metering and mixing of several active liquids, in particular for applications that are repeated according to an established and specific program or calendar.

With the creation and development of the economy of leisure, with new generations of the third age in full expansion, with increasingly concrete-paved cities, and with the vital necessity for a plant environment of leisure and pleasure, the markets for apartment plants and leisure gardening are booming throughout the world. The passion for and pleasure in personalizing one's space, the variety of crops, and the unique and specific needs linked to each of the plant types are inducing and will induce constraints and obligations that will multiply.

The awareness with respect to the environment is promoting the use of manure and biological fertilizers, often available in concentrated form, and even greatly concentrated for limiting the space requirement and the packaging. The plant radicals have seasonal needs and periodic needs for various inputs for feeding, growing, protecting and promoting the development thereof.

On one hand, there are, in trade, devices that make possible the specific and programmed watering of the plantings. On the industrial plane or with professionals of agriculture, there are systems for distribution and expanding over the extended crops.

On the other hand, there is, at the level of private individuals, an unsatisfied need for automating the metering and the distribution of specific and varied manure for making it possible to ensure a good application (metering, period, duration) of these products and to reduce the obligation linked to the simultaneous variety of crops and their differentiated needs.

The result is an application for a system or device that makes it possible to promote the simple application, at least semi-automatically, and even automatically, of specific and periodic nutritional inputs for a large variety of plant types in the environments of private individuals and professionals of small- and medium-sized businesses.

Devices for metered mixing of various products are already known in the state of the art, such as, for example, by the document EP 0 443 741, without, however, a final dilution stage being provided.

However, they generally have one or more of the following drawbacks: a complex and bulky structure with a large number of active elements, a complicated operating mode, and a high cost, limiting their use to professionals. Simpler devices are also known, but do not provide a service that is suitable for specific and reliable use.

In addition, with the exception of professional installations, known mixing devices do not generally relate to the field of application of this invention.

Actually, the targeted field of application relates more particularly to the consumption and the needs of private individuals in terms of biological liquid manure and all the other liquid products used for the growth and the maintenance of the plants of the interior, balconies, terraces, plant walls, gardens and green spaces for pleasure and ornamentation. To this are added small greenhouses of amateurs, enthusiasts of various plants and vegetables, as well as small and large businesses comprising a large number of plants on their premises.

The different types of manure and complementary products are increasingly delivered in the form of more or less viscous, concentrated liquid products. Manufacturers are competing to find the ways that make possible the best ergonomics of use. These adjustments, to be sure essential for the manufacturers of the products, only very partially respond to the following problems:

- Obligation to meter in several products,
- Obligation to distribute several products to several plant types,
- Obligation to apply doses of different periods and durations.

In addition, precision and optimization often cannot be achieved and met over the long term by private individuals.

For the purpose of meeting the needs expressed above and remedying the limitations of the existing devices and systems, this invention has as its object an automatic or semi-automatic device for controlled metering and mixing of several concentrated nutritional or fertilizing substances intended for plants.

Such a device should be easy to use, with a not very complex design that is adaptable, precise and reliable, not very bulky, and/or with a relatively low cost.

For this purpose, the invention more specifically has as its object a device that comprises, on the one hand, means for selective sampling of these substances in the corresponding tanks, and, on the other hand, means for fluid transfer composed of at least one fluid circulation line and at least one active element for displacement of liquid, and, finally, means for metering, mixing and diluting amounts of sampled and transferred liquid(s), with said device also comprising a control and management unit, preferably associated with a communicating and programming interface, controlling the sampling and transfer means and associated with measuring means and with means for monitoring the circulation of fluids in the device of the valve type, device characterized in that the measuring means comprise, on the one hand, a measuring means, preferably unique and advantageously with sequential use, of a basic volume of sampled concentrated liquid and having to be mixed and/or diluted, and, on the other hand, at least one means for measuring and/or for determining the final amount, preferably of the volume, of the metered solution obtained by dilution, after metering, of the concentrated liquid or the mixture of concentrated liquids.

The invention will be better understood, owing to the description below, which relates to a preferred embodiment, provided by way of nonlimiting example, and explained with reference to the accompanying diagrammatic drawings, in which.

Figure 6:
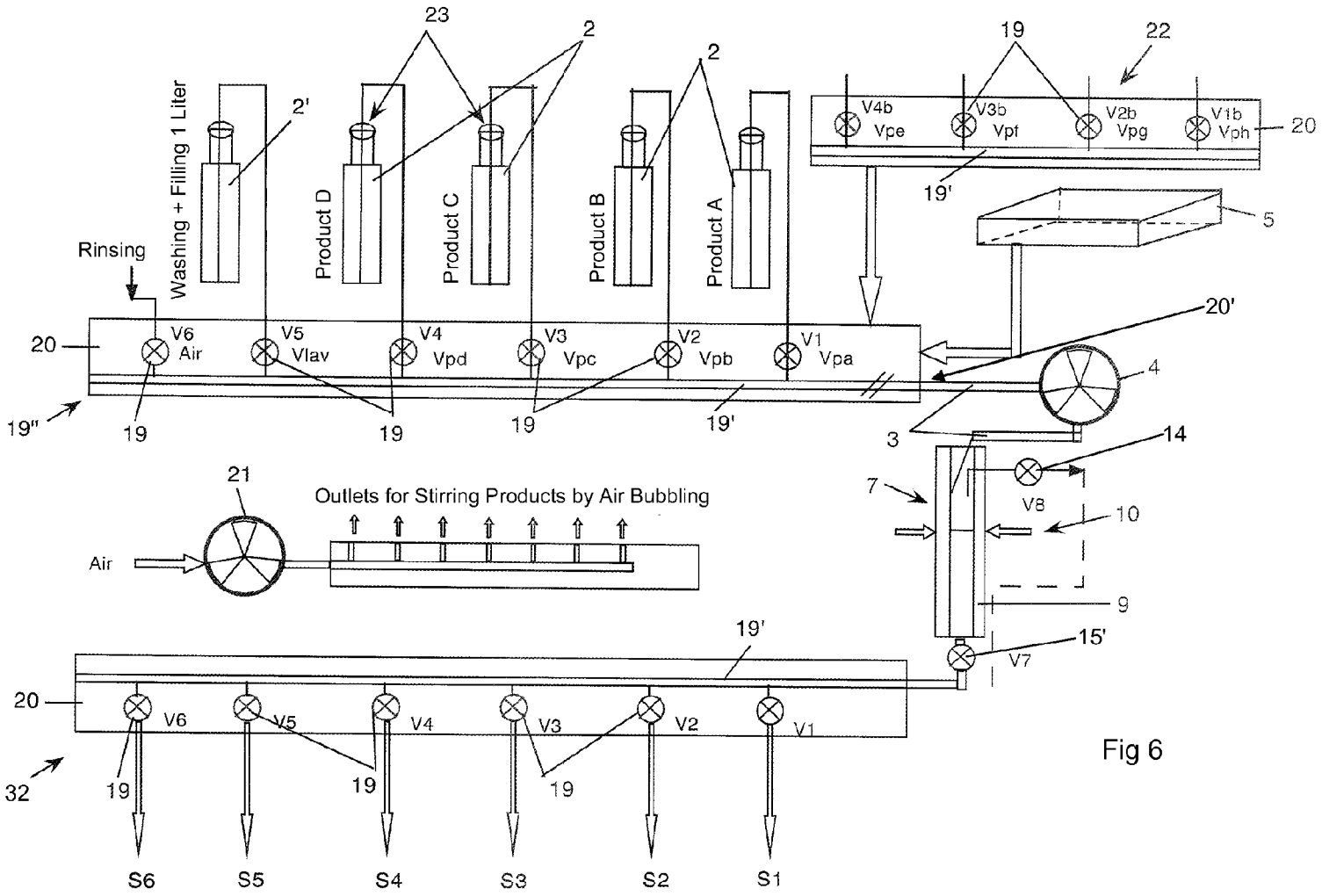
Figure 7A:
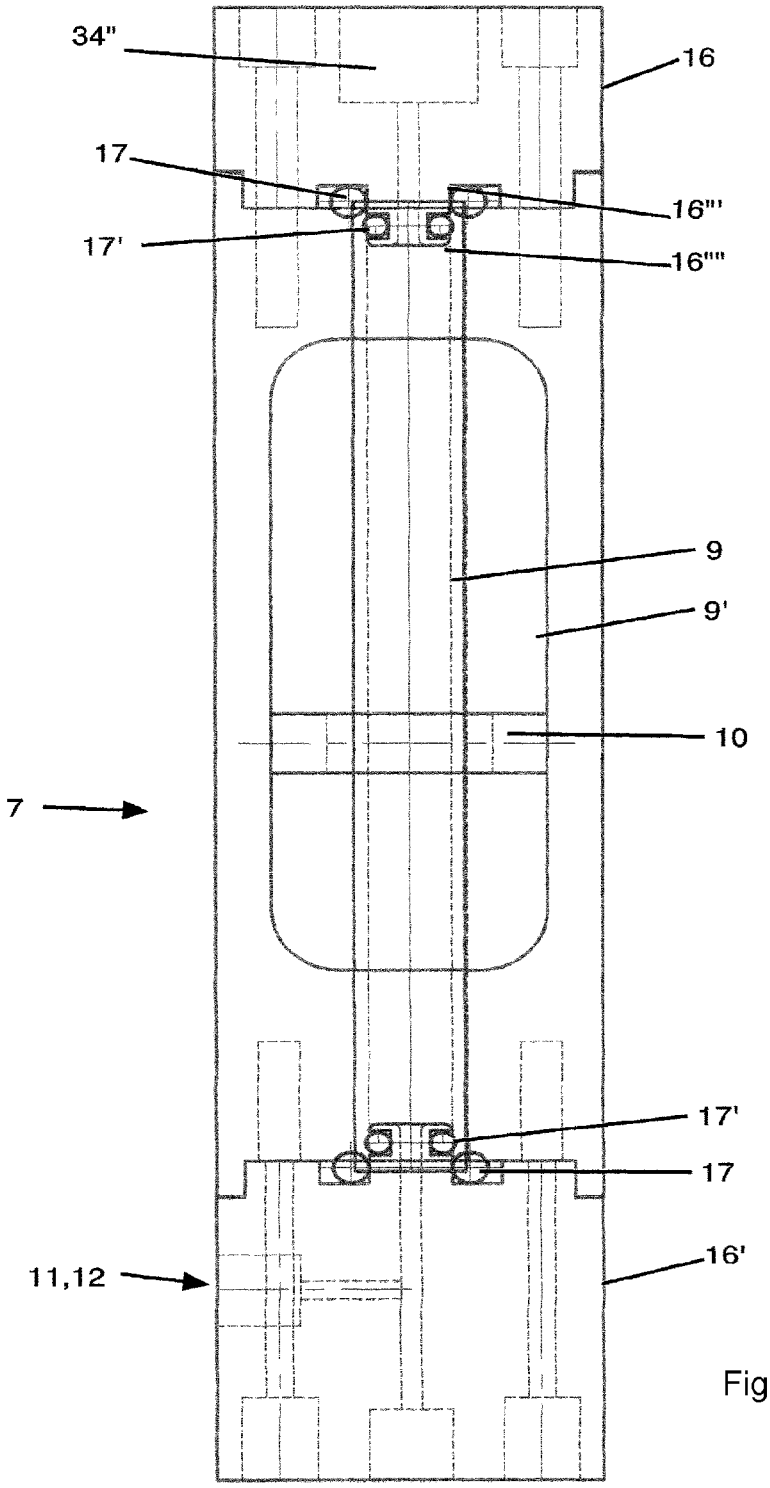
Figure 7B:
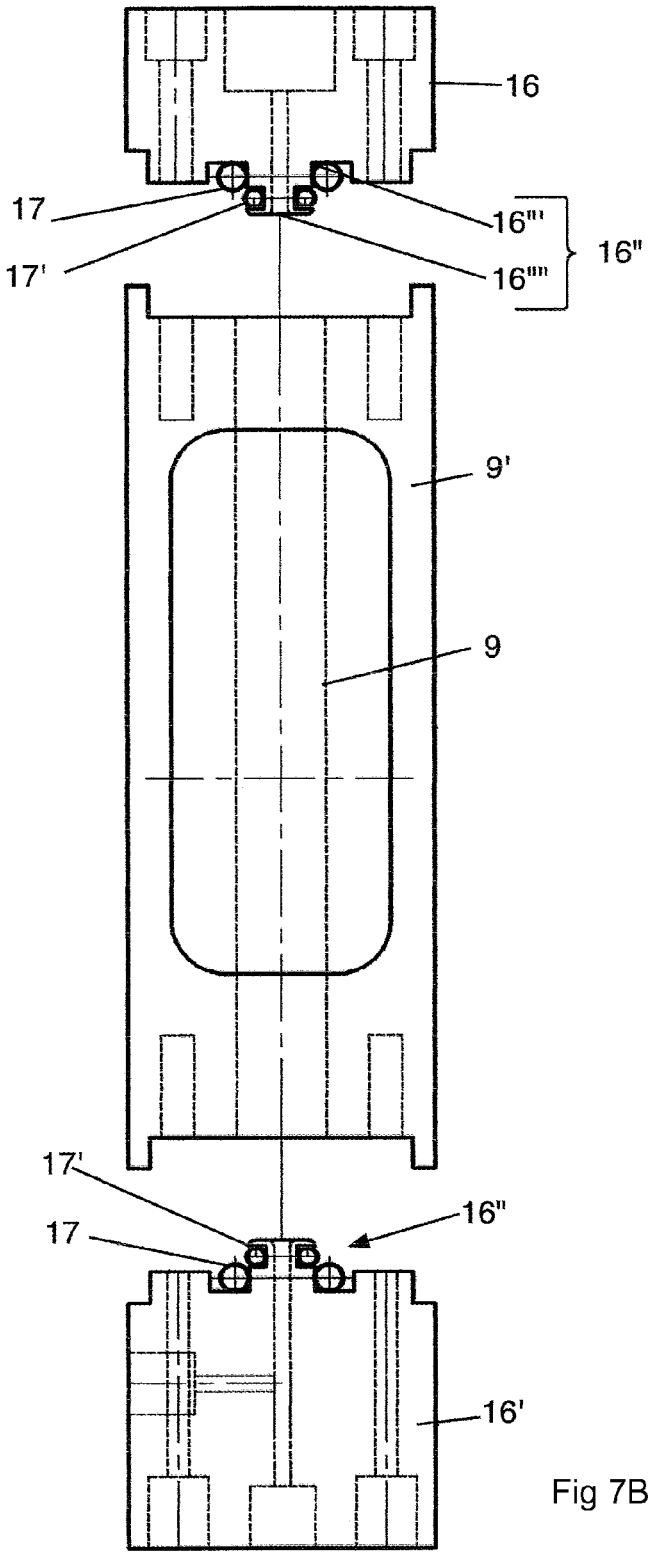

FIG. 6 is a functional block diagram that is similar to that of FIG. 1 of a variant embodiment of a device according to the invention, and FIGS. 7A and 7B are side-elevation views of a preferred practical variant embodiment of the sequential measuring means of basic volumes that are part of the device according to the invention, respectively in the assembled state (FIG. 7A) and before assembly (FIG. 7B).

Figure 1A:
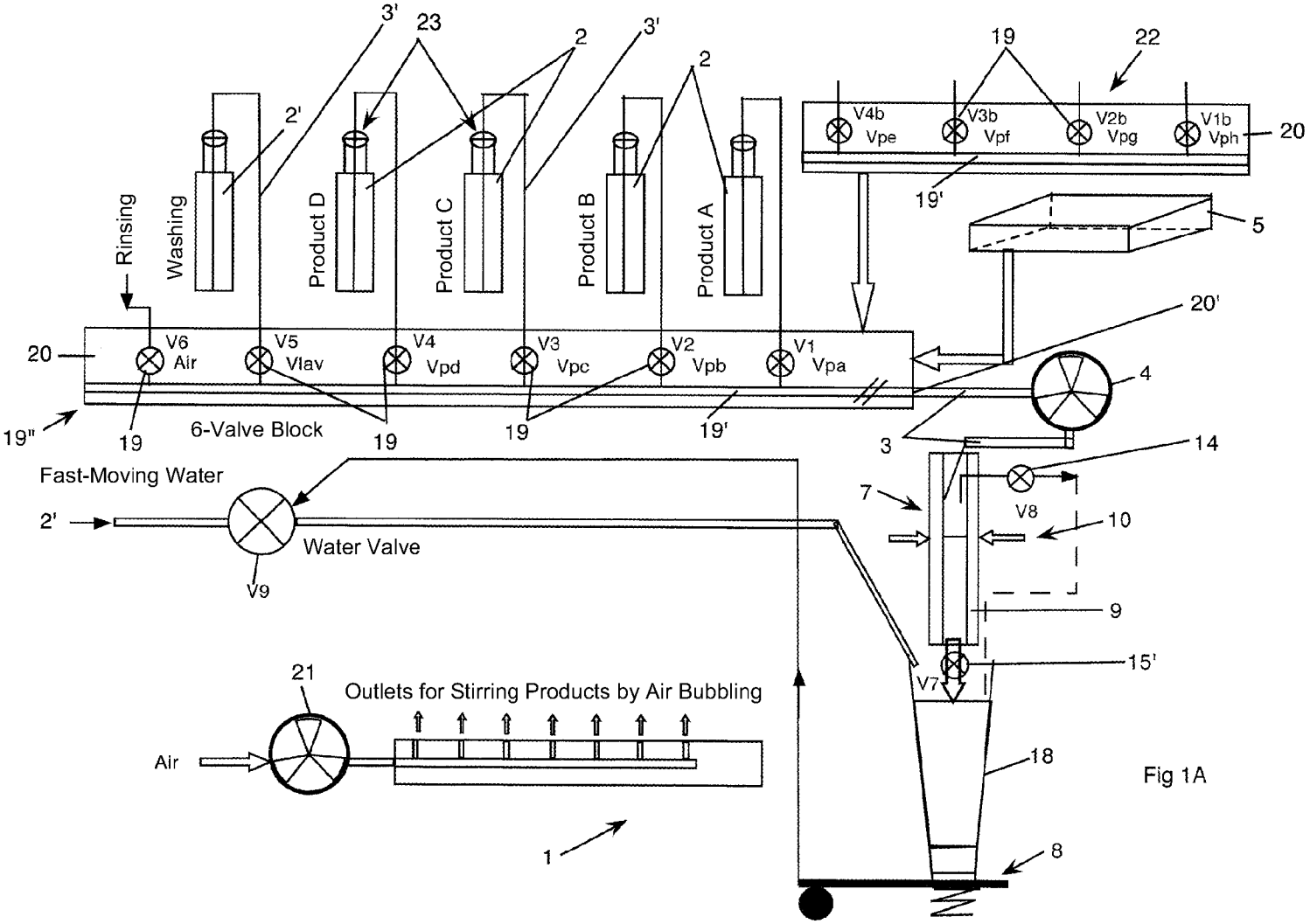
FIG. 1A is a functional block diagram of a device for controlled metering and mixing of several active liquids according to a first embodiment of the invention.
Figure 1B:
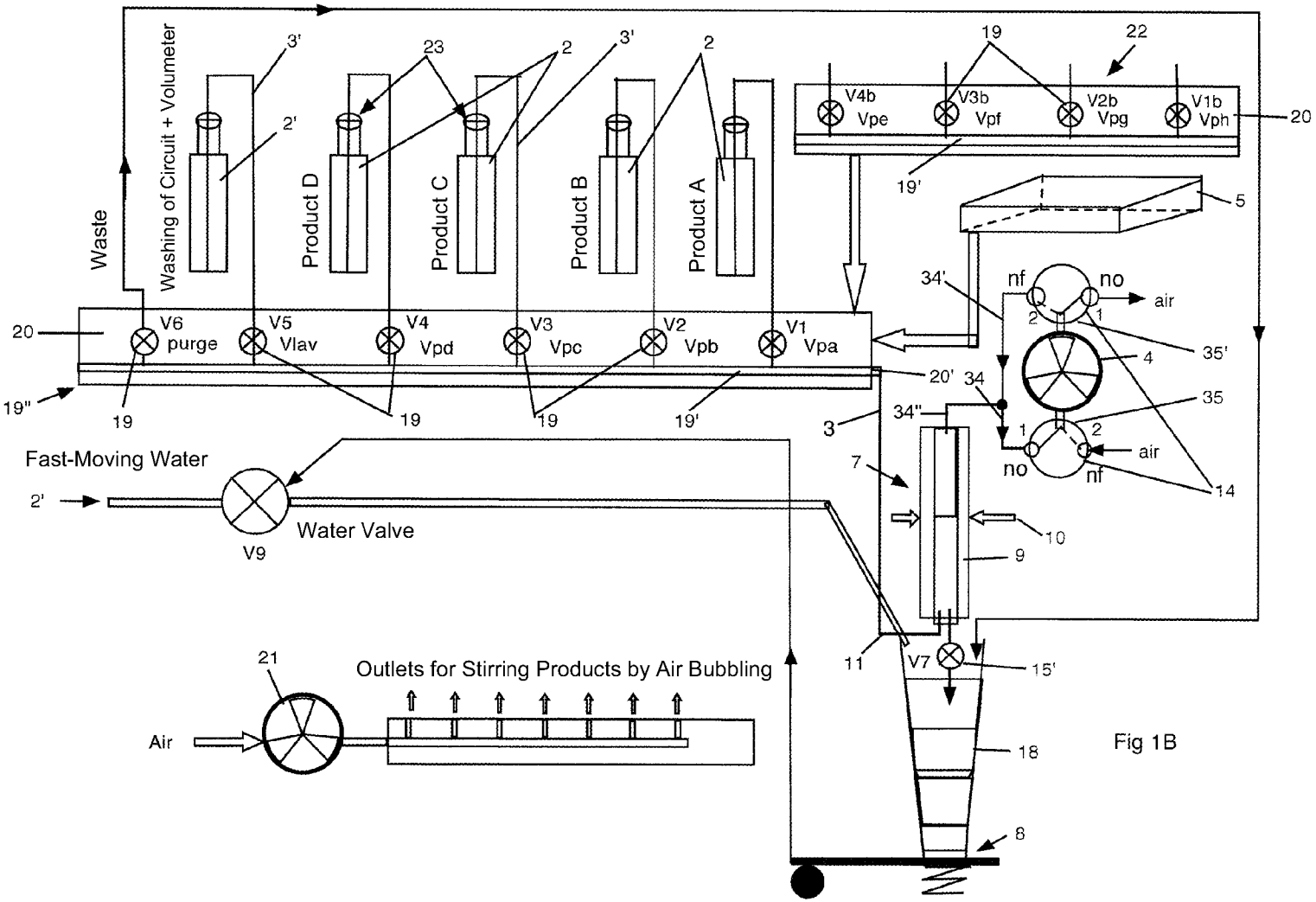
FIG. 1B is a functional block diagram of a device for controlled metering and mixing of several active liquids according to a second embodiment of the invention.
Figure 1C:
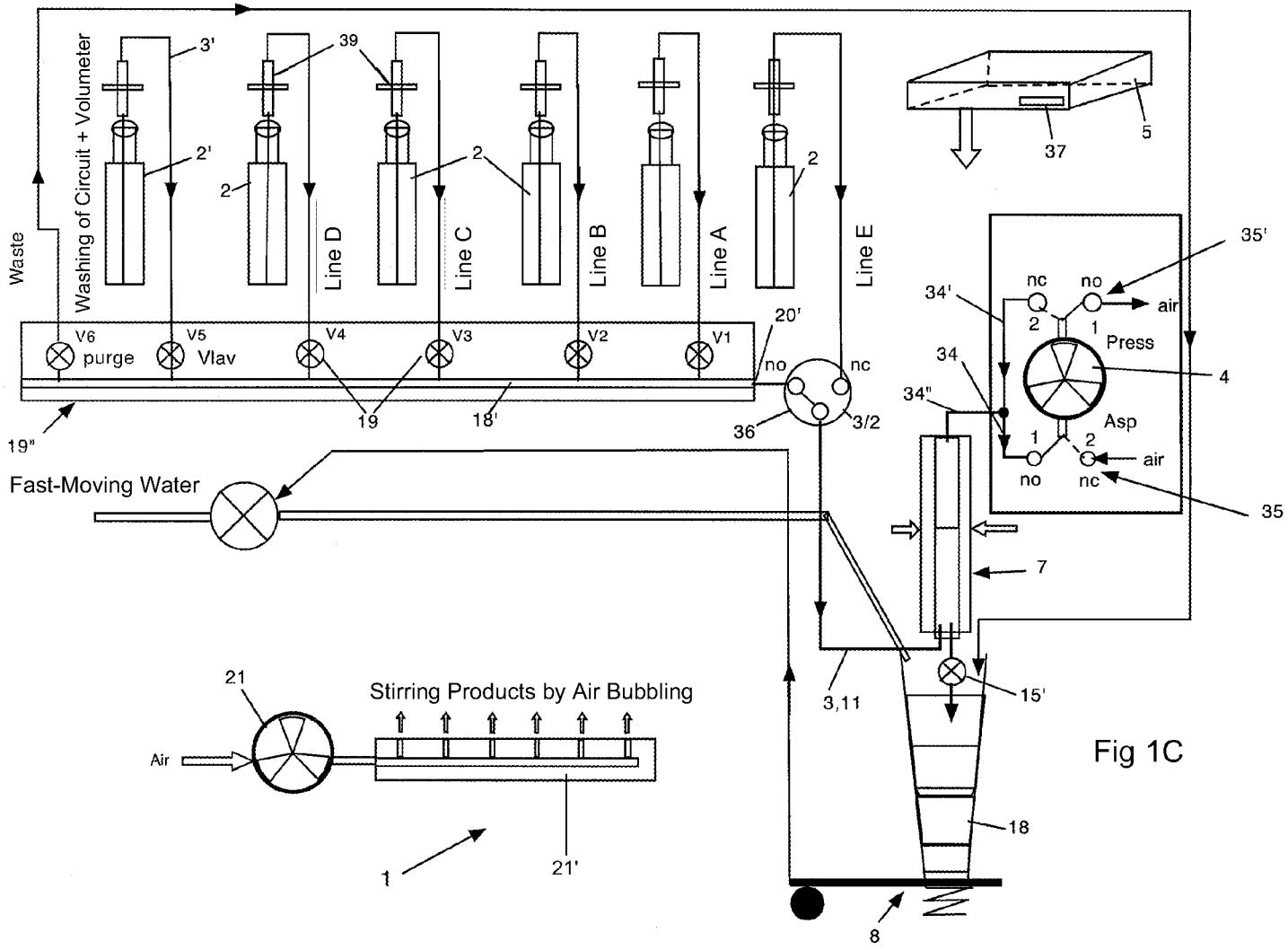
FIG. 1C is a diagrammatic representation, similar to those of FIGS. 1A and 1B, of a third embodiment of the invention.

FIGS. 1A, 1B and 1C symbolically represent an automatic or semi-automatic device 1 for controlled metering and mixing of several active liquids, in particular concentrated nutritional or fertilizing substances that are intended for vegetables.

This device 1 comprises, on the one hand, means for selective sampling of these substances in corresponding tanks or containers 2, and, on the other hand, fluid transfer means that consist of at least one fluid circulation line 3 and at least one active element 4 for liquid displacement (direct or indirect—with or without passage), and, finally, means for metering, mixing and dilution of the amounts of sampled and transferred liquid(s).

This device 1 also comprises a control and management unit 5, preferably associated with a communication and programming interface 6, controlling the means 3, 4, 11, 11', 13, 15, 23, 23' for sampling and transfer and associated with measuring means 7 and with means for controlling the circulation of the fluids in the device, of the valve type 12, 14, 15', and 19.

In accordance with the invention, the measuring means comprise, on the one hand, a single measuring means 7 with sequential use, of a basic volume of sampled concentrated liquid that has to be mixed and/or diluted, and, on the other hand, at least one means 8 for measuring and/or determining the final amount, preferably of volume, of the metered solution that is obtained by dilution, after metering, of the concentrated liquid or the mixture of concentrated liquids.

These arrangements make it possible to ensure high measuring precision by means of a simple-to-use means, adaptable to varied volumes and carrying out a double measurement, namely of the concentrated active substance and the ready-to-use dilute product.

Various embodiments of the sequential measuring means 7 of a basic volume of concentrated liquid can be considered.

However, consistent with a preferred variant embodiment, shown in particular by FIG. 3, this means 7 consists of a volumetric measuring means with optical detection, preferably an optoelectronic microvolumeter, primarily consisting of a calibrated tubular container 9 made of a transparent material, equipped with a level optoelectronic detector 10 and supply and draining means 11, 11', 12, 13, 14, 15, 15', 16, 16'.

Figure 3A:
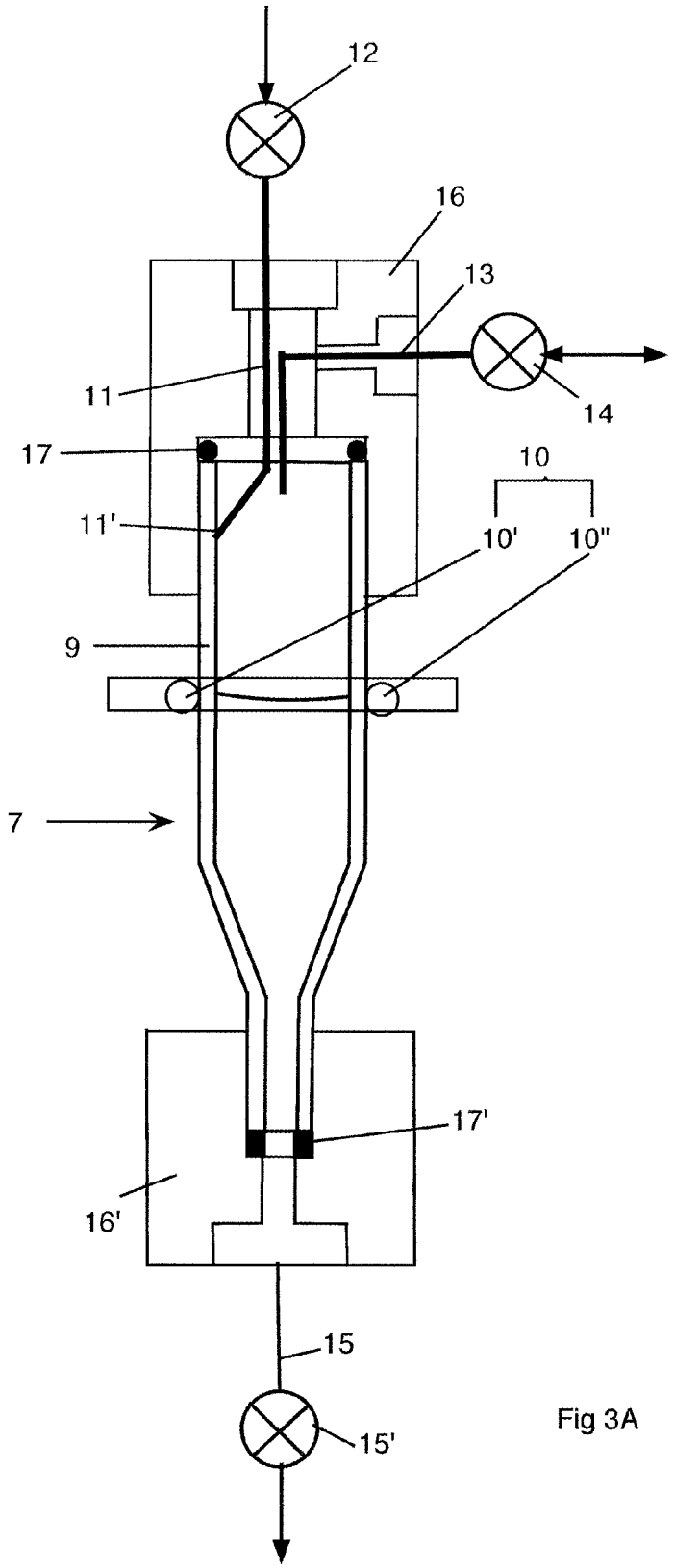
FIG. 3A is a diagrammatic representation of an embodiment of the means for measuring basic volumes that are part of the device according to the invention, as shown in FIG. 1A.

According to a first advantageous embodiment of the invention and relative to FIGS. 1A and 3A, the optoelectronic detector 10 that is mounted on the container 9 is of the infrared type and comprises an emitter 10' and a receiver 10" located on either side of said tubular container 9 and in an axial location corresponding to the basic volume to be measured, with said detector 10 being capable of detecting the presence of a meniscus between emitter 10' and receiver 10".

In addition, the supply means comprise, on the one hand, a first tube or pipe 11 connected to the line 3 for circulation of fluid from the fluid transfer means, preferably by means of an inlet control valve 12, and whose outlet 11' is in contact with the side wall of the tubular container 9, in the upper part of the latter, in particular above the optoelectronic detector 10, and, on the other hand, a second tube or pipe 13 that empties at the upper end of the tubular container 9 and that can be connected, by means of a corresponding valve 14, selectively to a washing liquid tank 2', preferably corresponding to the dilution liquid, or to the atmosphere, with liquids being displaced in a controlled manner under the action of the active element 4, by suction and transfer of said substances through said element.

Figure 3B:
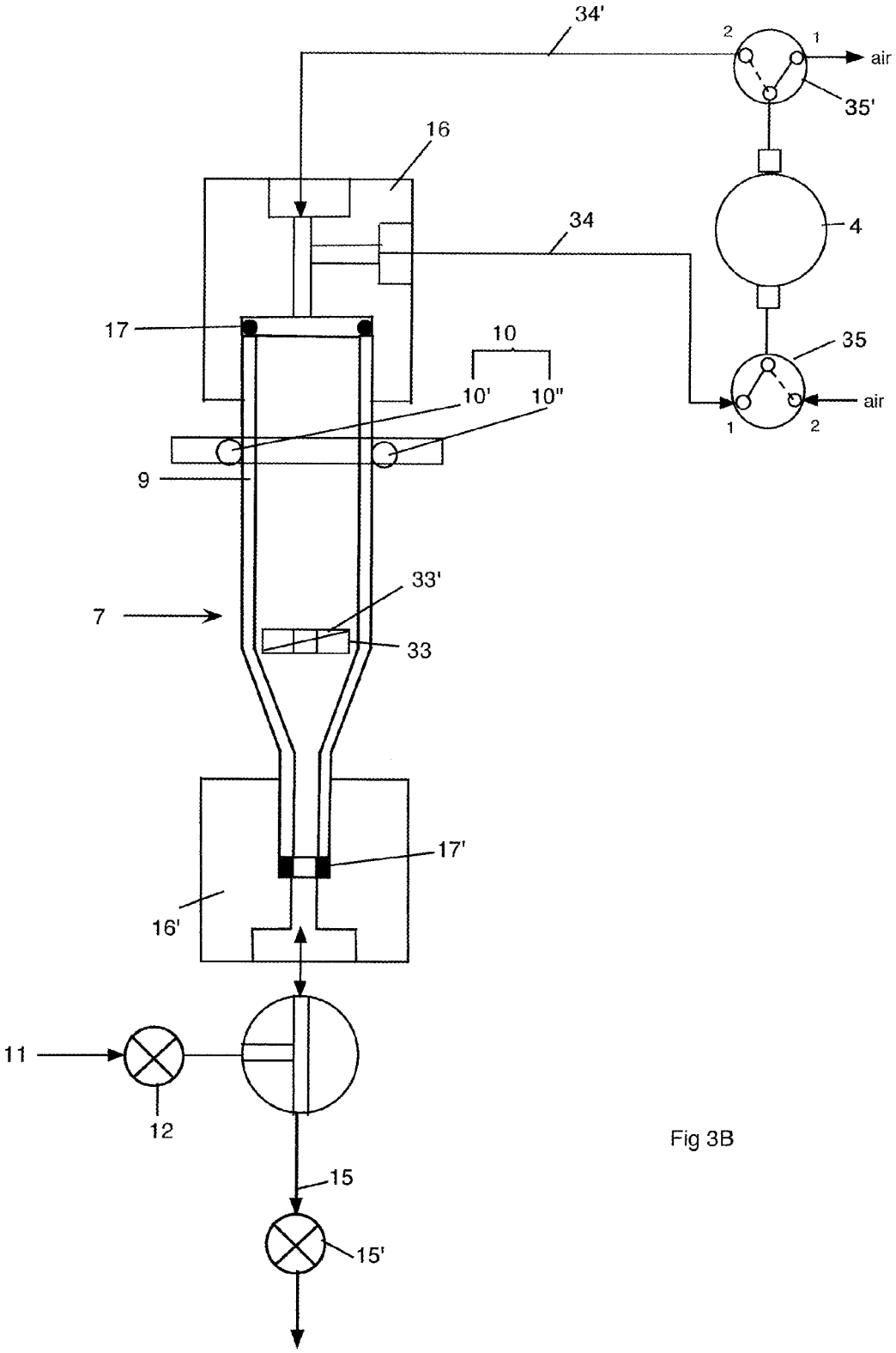
FIG. 3B is a diagrammatic representation of an embodiment of the means for measuring basic volumes that are part of the device according to the invention, as shown in FIG. 1B.

Consistent with a second advantageous embodiment of the invention, and as FIGS. 1B and 3B show, it may also be provided that the optoelectrical detector 10 that is mounted on the container 9, optionally of the infrared type, forms a light barrier and comprises an emitter 10' and a receiver 10", located on either side of said tubular container 9, and with an axial location corresponding to the basic volume that is to be measured (between the bottom of the container 9 and the light barrier 10), that said container 9 contains a float body 33, such as a calibrated ball, a cylinder or a disk that is free in movement, in the axial direction of the tubular container 9, that can be detected by the level optoelectronic detector 10 and whose density is at least slightly less than that of the active liquid for washing or dilution that is of lower density.

The float body 33 should satisfy certain characteristics and have certain properties for ensuring a reliable determination of the liquid volume in the tubular container 9 and should not lead to malfunctions.

Thus, the body 33:

Should always float and not sink

Should not stick to the wall of the container 9

Should not become locked by turning crosswise (in the case of a cylinder or a disk)

Should move in perfect harmony with the change in the liquid level.

Such an opaque float body 33 makes it possible to remove the color from the liquids that are to be measured.

Advantageously, the float body 33 consists of a non-woven disk, preferably with a diameter that is slightly less than the inside diameter of the tubular container, comprising on its outside periphery a threaded structure or pattern 33' that is made of a chemically neutral material relative to the different liquids that can be present in said tubular container 9.

As a variant, the float body 33 can also consist of a calibrated ball.

The advantages and properties of the two above-mentioned practical variant embodiments of the float body 33 can be summarized as follows:

The cylinder or disk offers a passage volume that is larger than that of the calibrated ball (central hole); its lift is thereby reduced The calibrated ball has a perfect geometry that ensures its lift and centering. By way of practical example, the passage, for air and liquid products, is 0.45 mm when the inside diameter of the tubular container is 6 mm and that of the calibrated ball is 5.55 mm.

The material of the float body 33 (calibrated ball or adjusted disk) is preferably, but not in a limiting manner, polypropylene or another material that is suitable for substances to be metered.

The outside threading 33' of the pierced disk that forms a float body 33 (for example of several millimeters of thickness) makes it possible to impart to it a rotational movement when the liquid rises and the float would have a tendency to stick against the wall of the container 9 owing to the surface tension of the latter. This tension is broken by the rotational force. The central hole of the disk 33 makes possible very good suction of the liquid into the container 9, and the unit moves in a laminar way.

Consistent with the second embodiment of the invention, it is advantageously provided that the displacement of the liquids from the tanks 2, 2' to the calibrated tubular container 9 is done by suction under the action of underpressure generated in said container 9 by the active element 4, with the draining of the liquids of said container 9 being accomplished by aeration or pressurization of the latter.

Such an alternative embodiment of the invention makes it possible to eliminate the need for any taking into account of the volume of the active element 4 in the determination of the final volume that is to be measured, not to contaminate the active element 4 (nor in particular to damage or disturb its operation), and to prevent a difficult and tedious cleaning of said active element 4.

In accordance with a variant of practical design, relative to the second embodiment above, the supply means can comprise, on the one hand, a first tube or pipe 11 that is part of the fluid circulation line 3 of the fluid transfer means and that has a fluid connection to the lower part of the tubular container 9, preferably by means of an intake control valve 12, and, on the other hand, intake lines 34 and injection lines 34' under air pressure having a fluid connection, in a separate manner or by a common downstream segment 34", to the upper part of the container 9, above the optoelectronic detector 10, with the suction and the injection being performed under the action of the active element 4 of the reversible type and/or associated with air supply control valves 35, 35'.

The device 1 according to the invention then has, as the accompanying FIGS. 1B and 3B show, the following characteristics:

Liquid is introduced via the lower part of the container that is part of the volumeter 7

The active element 4 (pump) is connected to the upper part of the volumeter 7 by means of two valves 35 and 35' of the 3/2 type (reversers)

A polypropylene float 33, whose density is less (0.9) than that of water, is introduced into the calibrated tube 9 of the volumeter The volumeter 7 operates by suction for the introduction of liquid products into the container 9

The volumeter 7 operates under pressure to empty the container 9 of its contents This change in state (suction/draining) is accomplished by the simultaneous alternation of valves 3/2 that control the "inlet-outlet" of the micropump that forms the active element 4

The position 1 of the valves 35 and 35' corresponds to the rest position of each of the valves (no=normally open)

The position 2 of the valves 35 and 35' corresponds to the activated position of the pump 4 (nf=normally closed)

The head-to-foot wiring of the valves 35, 35', relative to the inlet and the outlet of the pump 4, makes it possible to achieve suction at rest of the latter and the application of a pressure when they are activated.

It is advisable to note that the diameter of the ball, like that of the cylinder or disk, is to be large enough to offer a good lift surface, but it also should not disrupt the underpressure in the volumeter so as to be able to correctly draw in the products.

The second embodiment of the invention offers, consequently, the following advantages:

The pump 4, in all of its operating modes, draws in only air

The operation of the pump 4 is accurate and regular. It does not undergo any soiling, and the body and the suction membrane can be standard The optoelectronic detector 10 has never disrupted its operation (the liquid coming via the bottom of the volumeter 9). It can be regulated with minimum sensitivity. It operates as a light barrier The device 1 is extremely reliable and is indifferent relative to the nature of the products (color, viscosity, geometry of the meniscus) as well as the temperature and disruptions of the parasitic light.

So as to ensure firm holding of the tubes 11, 13 and 15 and a high-performing sealing at openings at the two upper and lower ends of the container 9, it is provided according to the invention that the first tube or pipe 11 and optionally the second tube or pipe 13 of the supply means, if necessary, the tubes or pipes of the intake lines 34 and injection lines 34' and the tube or pipe 15 that forms the means or the drain line of the calibrated tubular container 9, are made integral mechanically and connected in an airtight way to said container 9 by parts 16, 16' forming plugs and equipped with seals 17, 17' working with the inside surface and/or the outside surface of the tubular container 9, an outlet valve 15' being associated with the drain line 15 having a fluid connection to the lower end of the container 9.

Consistent with a practical and advantageous variant embodiment of the sequential basic measuring means 7, shown in FIGS. 7A and 7B of the accompanying drawings, the tubular container 9 can consist of a transparent tube portion with a calibrated inside volume, mounted with an essentially vertical arrangement in a support body 9', also having the optoelectronic detector 10, for example in the form of an optical fork, in that parts 16, 16' forming plugs are connected in an airtight manner to the upper and lower opposite ends of the tubular container 9 by being made integral with the support body 9'.

Advantageously, each plug 16, 16' comprises a stud 16" comprising, on the one hand, a base 16'" on which the corresponding end of the tube portion forming the container 9 interlocks with flattening of an outside seal 17, and, on the other hand, a head 16"" extending in a limited manner into said tube portion 9 and having a seal 17' that is applied against the inside surface of said tube portion 9, a conduit emptying into the inside of said container 9 passing through each stud 16" and having a fluid connection respectively, at the plug 16, 16' in question, either to air intake/injection lines 34, 34' or to a tube or pipe 11 that is part of the line 3 for circulation of fluids from the fluid transfer means and to a drain line 15, with insertion of an intake control valve 12 and a corresponding outlet control valve 15.

This design of the means 7 can use the detection of the meniscus or the detection of a float body 33, as described above.

The support body 9', made of an opaque material, houses the transparent tubular body 9 in such a way that only a small portion is cleared and visible (for the purpose of mounting the optical fork), thus limiting the disruptions linked to ambient light and promoting resolution and reliability of detection. Although different solutions can be considered for carrying out the continuous measurement of the volume of the metered solution obtained by dilution, it is advantageously provided that the means 8 consists of an electronic device for weight/volume conversion, such as an electronic scale (preferably general public) on whose plate 8' rests the container 18 that is intended to contain said final solution, thus ensuring a simple and precise solution implementing standard business equipment.

The measurement delivered by the electronic scale 8 is transmitted to the control and management unit 5 and is used by the latter as control information for controlling the valve (V9 in FIG. 1) for intake of dilution water into the container 18.

The latter, which is positioned at a predetermined location on the scale 8, is consequently supplied via two end fittings or discharge spouts 30 of which one is connected to the above-mentioned dilution water supply line and the other to the drain tube 15 of the tubular container 9.

The container 18 advantageously has a tapered shape that narrows toward its base (see FIGS. 1A to 1D), and the discharge spout 30 for water directs its jet over the inside wall of said container in such a way as to create a liquid vortex naturally, thus ensuring dilution by diffusion and mechanical action. The end of the discharge spout 30 for the concentrated substances coming from the volumeter 7 is essentially directed toward the center of the container 18 in such a way that said substances are discharged into the dilution liquid (water) that is present, without coming into contact with the walls.

In accordance with a characteristic of the invention, as shown in FIG. 1, the selective sampling means comprise, for each tank 2 of concentrated liquid active substance, a valve 19 with a very low dead volume, and the unit 19" of these valves 19 is cascade-assembled and mutually interconnected at their outlets by a single collecting and distributing channel 19'. Preferably, the bodies of the valves 19 that form the above-mentioned multi-path distribution unit 19" are made in a single block of material 20, in which the collecting and distributing channel 19' is also arranged.

In addition, the multi-path distribution unit 19" also comprises, on the one hand, a valve 19 whose inlet is connected to a washing and dilution liquid tank 2' and, on the other hand, a valve 19 whose inlet is connected to the atmosphere, whereby these two valves 19 are located respectively in the front-back and in the last position relative to the outlet 20' of the collecting and distributing channel 19' in the arrangement of valves 19 connected successively to said channel 19'.

For the purpose of being able to sample the liquid active substances of a large number of different tanks, the sampling means can comprise at least a second multi-path distribution unit 22, formed by at least a second cascade-assembled valve unit 19, mutually interconnected at their outlets by a collecting and distributing channel 19' and whose valve bodies are also made in a single material block 20, the outlet 20' of the collecting and distributing channel 19' of this second unit 22 of valves 19 advantageously being connected to the collecting and distributing channel 19' of the first unit 19" of valves 19, preferably between the outlet 20' of this last channel 19' and the first valve 19 of the valve arrangement forming said first unit 19" of valves.

The multi-path distribution units 19" and 22 can be, for example, of the type described in the document FR 2 664 671 or be based on an equivalent technology known to one skilled in the art.

When one or more of the active substances to be metered has/have a viscosity such that their transfer through the first valve unit 19" could prove problematic, it can be provided, consistent with a third embodiment of the invention shown in FIG. 1C (variant of the second mode), that the transfer and supply means comprise, between the selective sampling means 19, 19' and the sequential measuring means 7, preferably integrated in the fluid circulation line 3, a fluid switching means 36, such as, for example, a 3/2 valve (3 ports and 2 states), of which a first inlet is connected to the outlet of the collecting channel 19' of the selective sampling means 19, 19', of which a second inlet is connected either to a container 2, in particular of a more viscous product, or to a second multi-path distribution unit 22, and of which the outlet is connected, by a tube or pipe 11, to the inlet of the calibrated tubular container 9 of the basic sequential measuring means 7.

When a second valve unit 22 is implemented, it is well understood that its structure will be adapted to the viscosity of the substances that pass through it.

So as to be able to use tanks 2 of varied size, shape and opening, and to sample the liquids under optimal conditions, in particular relative to homogeneity, the sampling means can comprise, for each tank 2 of concentrated liquid active substance, in the form of a container such as a flask, bottle or the like, a polyvalent and multifunctional connecting means 23 constituted by a structural body 23' forming a universal plug and through which a first tube 24' supplied with bubbling gas, preferably pressurized air, passes and through which a second tube 24 for the intake of the liquid that is contained in the tank 2 in question passes (FIGS. 4 and 5).

Figure 4A:
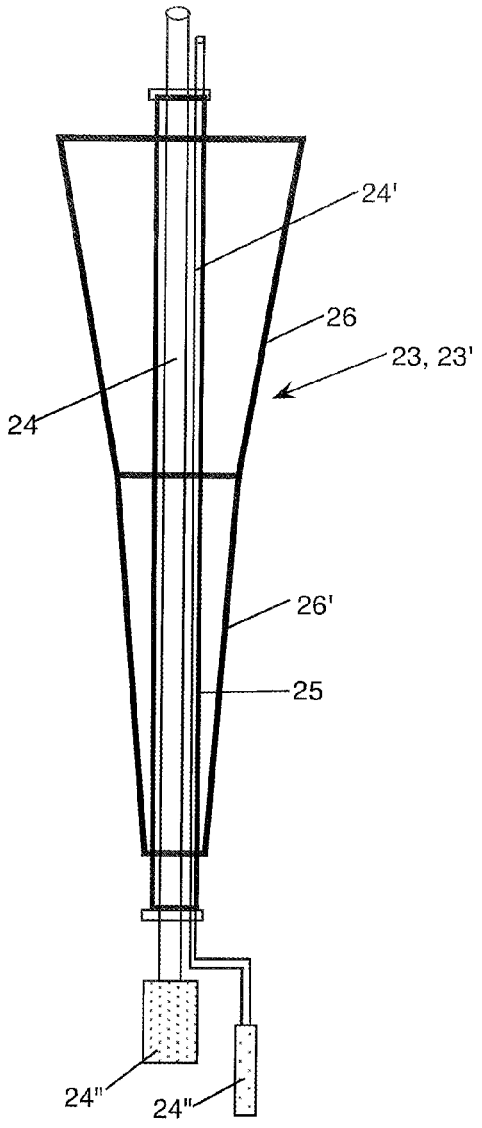
FIGS. 4A and 4B are side-elevation views of two variant embodiments of a polyvalent connecting means that is part of the device according to the invention.
Figure 4B:
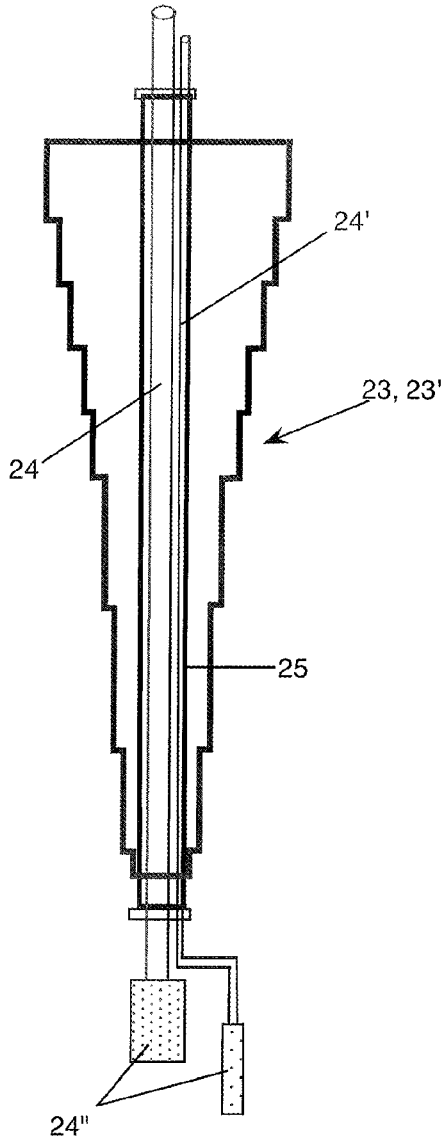
Figure 5A:
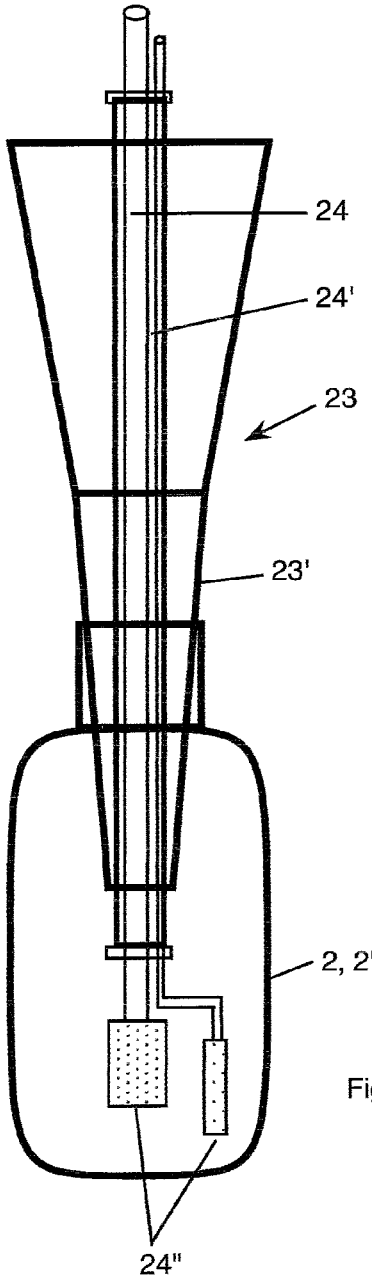
FIGS. 5A and 5B are transparent side-elevation views of the connecting means in place in and on a liquid tank, relative to two alternative designs of the polyvalent connecting means of FIG. 4A.

The structural body 23' forming a "universal plug" can consist of, for example, a hollow body with a shape that is elongated and tapered in the direction of the end that is introduced into the tank 2 being considered and comprises means 25 for support and holding of the two tubes 24 and 24' that pass through it, with the ends of the latter being provided with filters 24" (FIGS. 4A, 4B and 5A).

Figure 5B:
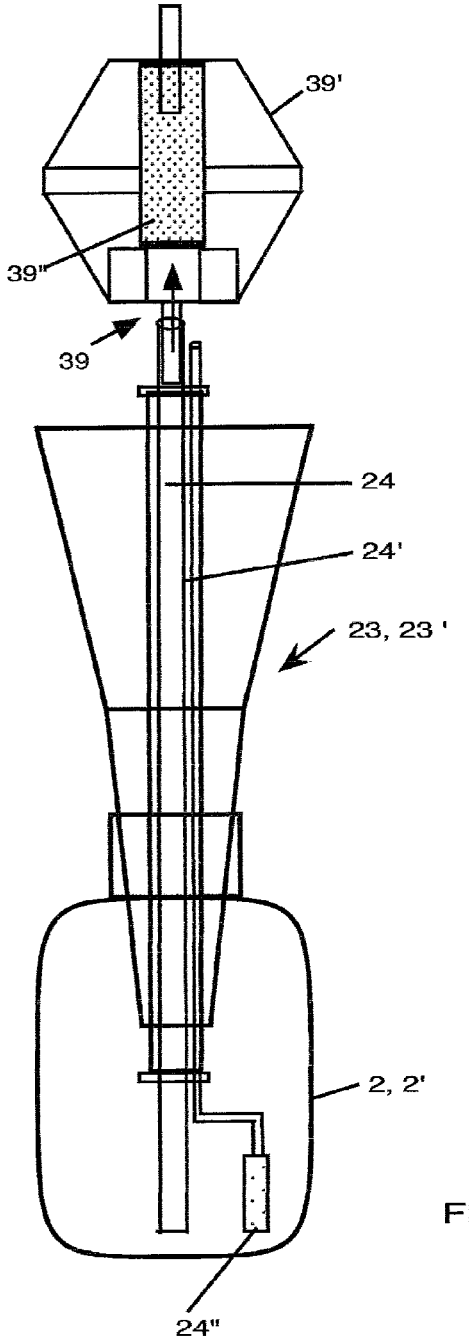

The filters ensuring the filtering of the sampled liquid streams can, according to an alternative design (shown in FIG. 5B and symbolically in FIG. 1C), be mounted on the outside, on the upper part of the body 23' of the plugs 23, preferably in an easily detachable way for the purpose of their maintenance and cleaning. Advantageously, and as FIG. 5B shows, these outside filters 39 comprise, for example, filtering bodies 39" that can be mounted in transparent boxes 39' in such a way as to allow a direct visual monitoring of their degree of soiling and the verification of the presence of liquid in the sampling and transfer conduits, connected to the filter 39 being considered (filters used in the injection systems of diesel engines optionally can be adapted as filters 39).

Consistent with two possible practical variant embodiments for the structural body 23', the latter can either consist of two contiguous truncated parts 26, 26' that have angles at different peaks (FIG. 4A) or have an overall truncated outside shape with a staged or stepped structure (FIG. 4B), with each step itself being able to have a truncated shape.

The outside surface of the body 23' can optionally be covered by a layer made of resilient or rubbery material or for the variant of FIG. 4B can comprise a compression joint, for example an O-ring or other, at each of the steps.

As a variant to the containers 2 of varied shapes and sizes mentioned above, coming from different manufacturers and each containing a product with specific characteristics of structure and concentration, it can also be provided that the different tanks 2 of active substances come in the form of a unit of cartridge-type containers, preferably of standardized shape and optionally grouped physically in a packet 2", with the substances of the containers 2 being metered by nature and by volume to satisfy the needs of one of the development phases of a plant, with the receiving sites of said containers 2 optionally being provided with electronic and/or mechanical means of automatic recognition of the type and characteristics of the containers 2.

Figure 1D:
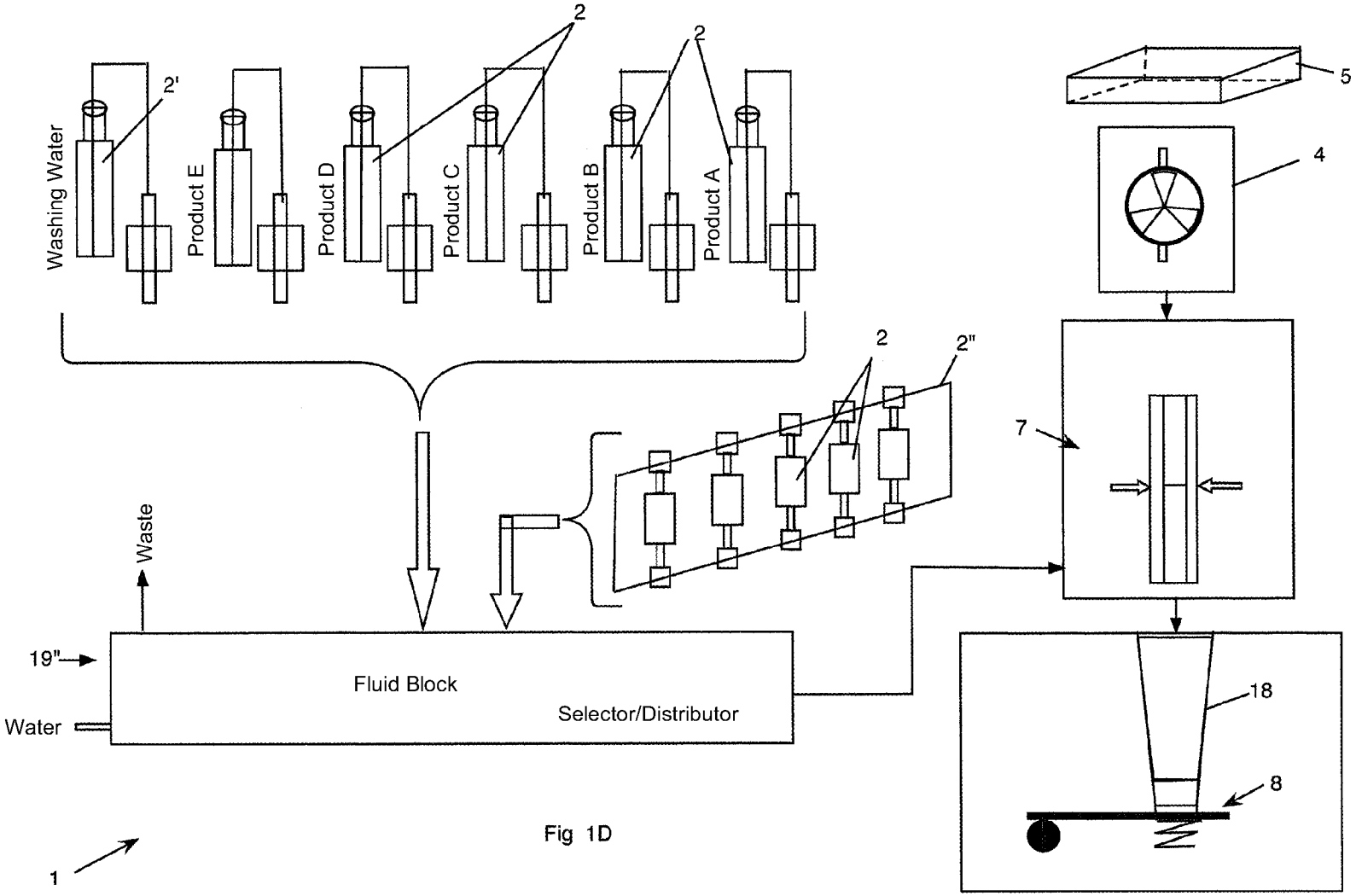
FIG. 1D is a symbolic representation of the metering and mixing devices shown in FIGS. 1A to 1C, illustrating the possibility of modular embodiment of these devices, as well as two possible variants for their supply of active substances to be metered, mixed and diluted.

FIG. 1D of the accompanying drawings symbolically illustrates the implementation of the two possible types of containers 2 by the device of the invention.

Figure 2A:
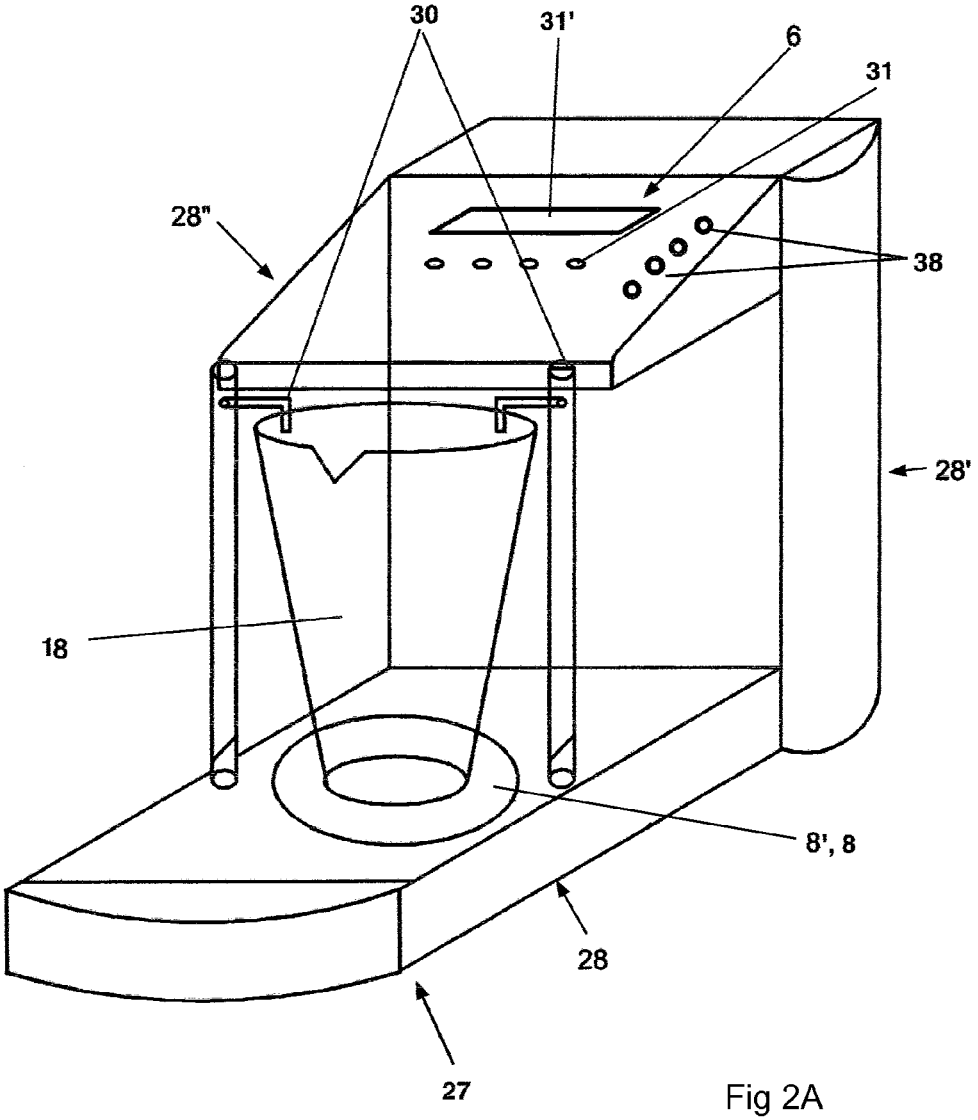
FIGS. 2A and 2B are diagrammatic representations of the two constituent complementary parts of the device that is shown overall in FIG. 1, according to a practical embodiment of the invention.
Figure 2B:
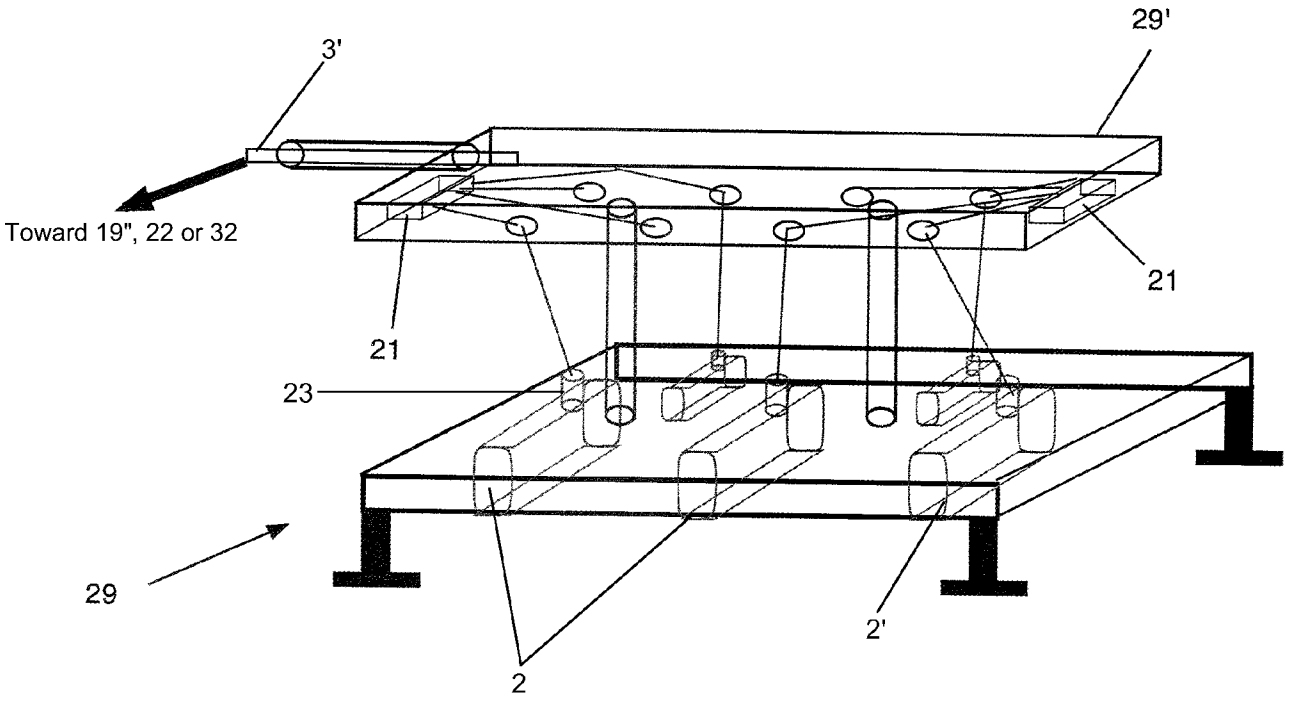

In accordance with a possible physical design for the device 1 according to the invention, illustrated in FIGS. 2A and 2B, the latter primarily consists of two modules 27 and 29 that are connected to one another, namely:

- A first module 27 in the form of a box with a C-shaped structure with a first lower part 28 forming a base and containing the continuous measuring means 8 in the form of an electronic scale, a second median part 28' forming a structural upright and advantageously containing the active element 4, with the volumeter 7 and the valve units 19", 22 being part of the selective sampling and transfer means, with a wing-shaped third upper part 28", located at a distance above the base 28, having the interface 6 for communication and programming and containing the control and management unit 5, a first part of the fluid and selective sampling transfer means thus being distributed between the second and third parts 28', 28", and
- A second module 29 (shown diagrammatically and partially by transparency in FIG. 2B) in the form of a support or a box for storage with receiving sites for the tanks or containers 2, 2', comprising an upper box or cover 29' integrating a complementary part 3, 23 of the sampling and transfer means, as well as means 21 for homogenization by bubbling of liquids that are present in said tanks 2, 2'.

In accordance with an additional characteristic of the invention, the device 1 can also integrate, at the first module 27, and relative to the control and management unit 5, at least one reader 37 of programmable-memory media, such as USB-type keys and/or Sd-type microcards, and the interface 6 for communication and programming can comprise light signaling lamps 38 indicating operating phases in progress and/or possible primary malfunctions.

In these modules, in particular in the first module 27, the different functional components can be advantageously grouped into blocks or separate physical units, such as a fluid block, a pump/engine block (for example, mounted on cylinder blocks to dampen the vibrations), a volumetric detection block, an electronic block, and a display and control block, promoting the manufacturing and maintenance of the device 1 according to the invention.

More specifically, and as FIG. 1D diagrammatically shows, the device can have a functional modular structure, with its different essential functional components physically being constituted in the form of separate material blocks, such as, in particular, a transfer block integrating the active element 4, an electronic block integrating the control and management unit 5, a measuring block integrating the sequential measuring means 7, a selector/distributor fluid block comprising one or more blocks of valves 19, 12, 14, 15', and a weight/volume conversion block integrating the scale.

According to another variant embodiment of the invention shown by FIG. 6, the device 1 can also comprise a means 32 for selective distribution of active liquids sampled in the containers 2 and quantified by the measuring means 7 in the form of a unit of cascade-assembled valves 19 that are mutually interconnected at their inlets by a single supply channel 19' that has a fluid connection to the outlet of the basic volumetric measuring means 7, and a means for determining the metered solution obtained by dilution is associated with each outlet of valve 19, sequentially in separate containers (resting on as many measuring means 8) or in a continuous manner by injection in one or more circulating liquid stream(s) (for example, of an automatic spraying system).

The structure of this variant may be similar to the one of FIG. 1A or FIG. 1B, with the exception of means 8 and container 18.

Actually, in the variant according to FIG. 6, the device 1 has multiple outlets that can come in different shapes.

Thus, each of the outlets can either dump into a container 18 that is associated with an individual and sequential measuring means 8, for example by weighing as in the other embodiment of the invention, or empty into a distribution circuit with a controlled flow of an irrigation and nutrition fluid (not shown).

The control of the block 32 of valves 19 is carried out in a manner that is similar to other blocks of valves 19" and 22 by being adapted to its inverted configuration and to its specific function.

In the following description, a practical embodiment of structure and operation of a device according to the first embodiment of the invention is mentioned in more detail by way of illustration and in a non-limiting manner, and in relation to FIGS. 1A and 2 in particular.

The basic device 1 (with only the block of valves 19") consists of, for example, a metering device/selector/mixer of four products (selection from among four products) and comprises a rinsing channel.

It can be, for example, calibrated and programmed to deliver volumes of between 1 and 5 ml by execution of 1 to 5 times the basic cycle. The distributed volume will be mixed directly with 1 liter of water, for example. As FIGS. 1 and 2 show, the diversity of the products and substances to be mixed can be very easily increased by doubling the selection block 19", with a second block 22 (in the example of FIG. 1, eight different products can be selected).

In relation to FIG. 1A, the device 1 more specifically comprises:

- A block 19" of six solenoid valves 19, whose first four elements, v1 to v4, are used to select a product from among four products (product A to product D). The valve v5 is set aside for washing the distribution and measuring circuit; the valve v6 makes it possible to instill air for purging, from its liquid contents, the entire fluid circuit for distribution of products, or the block of valves 19" itself, the intake micropump 4 as well as the measuring microvolumeter 7 and the entire fluid circuit that is associated with it. These elements are described more precisely below.

A second block 22, with, for example, four solenoid valves, can be associated with the preceding block to create a unit that is capable of distributing eight different products (product A to product H).

The outlet of the valve block(s) is connected to a means 7 for volumetric measurement that is capable of measuring 1 ml with a precision of 1%, or 10 μl. This means will be the subject of a specific description below.

The outlet of the microvolumeter 7 empties into a container 18 or graduated receptacle for three liters of a cocktail of ready-to-use products.

A water valve (V9) controls the distribution of the water volume for meeting the needs programmed for 1 liter, 2 liters or 3 liters of a products-water mixture.

The measurement of volumes (1 liter, 2 liters, or 3 liters) is ensured by a household-type scale 8 whose relative precision is on the order of one gram per one kilogram.

A secondary device that consists of an aquarium-type air pump 21 (100 l to 400 l/hour) ensures, by air bubbles, the homogeneity of the contents of each of the products in their analogous flask or tank 2.

All of these elements that constitute the device are controlled by means of a micro-computerized electronic controller forming a control and management unit 5.

The man-machine dialogue is done by means of, for example, four keys 31 whose functionality is displayed on a liquid crystal screen 31' of four lines of twenty characters. The choice of programs, the selection of products, and their distribution parameters as well as all of the other functions are displayed on this same screen.

The device 1 according to the second embodiment, illustrated by FIG. 1B, picks up most of the constituent elements of the first embodiment that is described above (identical numerical references have been used for similar elements), with only the displacement method of the liquids, the arrangement and the mode of operation of the active element 4 and the structure of the volumeter 7 with its accessories being different, as the description above shows.

To deliver a ready-to-use product, or typically 1 to 5 ml of a product or cocktail of products, in one liter of water, the device 1 according to one of the embodiments of the invention will implement several functional procedures that are specific to each operation and according to a well-established protocol.

By way of example and to illustrate the operation of the device 1 of FIG. 1A, the production is carried out in the container 18 of a cocktail that consists of products A (2 ml), B (2 ml) and C (1 ml) in 1 liter of water for "a plant growth phase."

The consecutive operating phases for ensuring this result are as follows:

Homogenization, by instillation of air bubbles in each of the flasks 2 of products A to C by means of the air pump 21 and the "bubbling" distributor 21'. This operation, prior to any distribution, is important for homogenizing the liquids that are to be distributed.

Pre-filling of several 250 ml of water in the container 18.

Distribution of the product A, by intake of the first 1 ml of product A. The pump 4 is activated until a meniscus of liquid of the product A disperses the light beam received by the detector 10 positioned on the microvolumeter 7 for measuring 1 ml of product in the circuit that extends from the valve 19 for selection of the product A, on the block of valves 19", by passing through the inside of the micropump 4 (approximately 250 μl) and the length of the fluid wiring pipes 3. With the liquid level reached, the valve A (V1) closes and the air valve v6 opens, and the pump introduces air into the measuring circuit by expelling the liquid that resides in the pipes or conduits, the pump 4 and the volumeter 7, with it all emptying into the container or beaker 18. A second identical cycle repeats for producing the 2 ml that is required. An operating cycle that is identical to the one that is described is carried out for delivering 2 ml of the product B, and then the required amount of the product C. At the end of the entire process for distributing products, a washing operation will be performed.

Washing of the measuring circuit. To do this, the valve v5 is open and several "water measurement-distribution" cycles are carried out, as well as additional operations of cleaning the upper part of the volumeter 7 by disposing of the surplus by means of the expansion channel 13 whose outlet pipe also dumps into the container 7.

Measurement of 1 liter of water. The water valve (V9) is open, and the water intake pipe delivers—at a high flow rate—the water that is required for ensuring a total weight of 1,000 g. The error that is made is several mg of water, those of products, for 1,000 mg theoretical. This error is perfectly acceptable within the context and for the use of the final product.

Preparation of 2 to 3 liters of final product. The distribution operations are multiplied by volume of each of the products by the number (modulo 1) of the required final volume. For example: 2 liters of final product of the preceding cocktail would involve the distribution of 4 ml of product A (2×2 ml), 4 ml of product B, and 2 ml of product C, the entire batch in 2 liters of water or a weight of 2,000 g.

The first module 27 that forms the primary functional part of the device 1 or the apparatus according to the invention has, seen from the side, a C shape and comprises three constituent parts, namely (FIG. 2A):

A base 28 or a lower part in which the numerical scale 8 for measuring and displaying the weight is implanted and with which are associated:

The container 18 positioned on the plate of the scale 8. (The presence of the container can be detected by an electromagnetic device, for example of the Reed switch type, with the container being provided with a magnet or the like), The two distribution columns, with the left column delivering the final water volume and the right column delivering the volumes of products.

The rear part or upright 28' inside of which is implanted the fluid plate that supports all of the fluid control elements of the apparatus 1.

The upper part or wing 28" that integrates the micro-computerized electronic plate that forms the control and management unit 5 and the communication interface 6 with:

An LCD display of 4 lines, 20 characters (screen 31'),

Dialogue keys 31, of which there are four, for example. The action of each key is indicated on the surface of each of them. This action varies according to the levels of interaction in each of the menus of the software of dialogue, programming, and monitoring.

The primary objective that is sought by this invention is to provide, to the enthusiasts and fans of a plant environment of flowers and plants, the means for managing nutritional inputs in an easy and non-demanding way during the growth and flowering phases of multiple and varied plants.

These nutritional inputs, which can come in solid form (powder) or liquid form, today are proposed by different suppliers of international scope. Only the liquid products or products that are put into liquid form are taken into account. Each of these potential suppliers proposes programs for applications of nutritive inputs simultaneously using several specific elements of a particular action.

These programs are generally spread over approximately 4 to 7 weeks for each of the growth and flowering phases, or more than 8 to 14 weeks total per crop, and require that specific and differentiated amounts be delivered daily according to the nature of the input and the week of the program in progress. The multiplication of the variants of nutrition programs, based on the variety of the plants and the variety of their growth and flowering period, produces a daily obligation for several weeks as well as a difficult and tedious management of all of the parameters that are to be observed.

The purpose of the device or apparatus 1 according to the invention is to provide for everyone, without a particular qualification, the possibility of obtaining the best results for growth and flowering in its ornamental and pleasing plant environment and thus to satisfy, without constraint, a passion that falls within the framework of optimization of and respect for nature.

The device 1 can integrate several utility programs that make it possible to propose operations that are suitable for different and evolving situations.

These programs can be provided with the apparatus or the device 1 (programming of origin), be associated with specific products bought subsequently (downloading from the site of the manufacturer, for example), or optionally be designed by the user on a separate computer and transferred into the memory of the unit 5 of the device 1, for example by means of a flash memory, a USB key, or a micro-SD-type memory circuit.

By way of example, and to meet the needs of a category of plants or a set of vegetables obeying identical cycles of nutritive needs for growth, it can be provided to supply by nature and by amount all of the products that are mentioned in the programs that are illustrated in Tables 1 and 2 below.

TABLE 1

Indoor Green Plants
Beginning on: 10 Days

| Growth | Week 1 | Week 2 | Week 3 | Week 4 |
|---|---|---|---|---|
| Product A | 2 ml | 3 ml | 4 ml | 5 ml |
| Product B | 2 ml | 3 ml | 4 ml | 5 ml |
| Product C | 1 ml | 1 ml | 1 ml | 1 ml |

TABLE 2

Outdoor Green Plants
Beginning on: 2 Days

| Growth | Week 1 | Week 2 | Week 3 | Week 4 |
|---|---|---|---|---|
| Product A | 2 ml | 3 ml | 4 ml | 5 ml |
| Product B | 2 ml | 3 ml | 4 ml | 5 ml |
| Product C | 1 ml | 1 ml | 1 ml | 1 ml |

In Table 1, it is noted that on each day of the week 1, it is necessary to provide 2 ml of product A, 2 ml of product B as well as 1 ml of product C, the batch diluted in 1 liter of water, to the plants. For week 2, Table 1 shows that the volumes of product A and product B are 3 ml and that they also increase by 1 ml on week 4. The apparatus 1 makes possible the daily preparation of programmed amounts and follows the thus determined program for 4 weeks.

This program can be used to provide nutrients to another category of plants staggered over time: this is the case that is illustrated by Table 2.

Thus, the apparatus 1 makes it possible to manage in real time several identical or different growth programs as well as several flowering programs such as the one provided by Table 3. The apparatus 1 is equipped with standard programs whose values (see tables) can be modified by the user and thus make it possible to create, starting from a preinstalled software base, the implementation and the execution of personalized programs.

TABLE 3

Outdoor Flowers
Starting in: 2 Days

| Flowering | Week 1 | Week 2 | Week 3 | Week 4 | Week 5 | Week 6 | Week 7 |
|---|---|---|---|---|---|---|---|
| Product D | 4 ml | 5 ml | 6 ml | 6 ml | 6 ml | 3 ml | Water |
| Product E | 4 ml | 5 ml | 6 ml | 6 ml | 6 ml | 3 ml | Water |
| Product F | 1 ml | 1 ml | 1 ml | 1 ml | 1 ml | 1 ml | 1 ml |

One of the major components of the device or the apparatus 1 according to the invention is the basic measuring means 7, or microvolumeter.

The latter is designed to measure, with precision, small volumes of different liquids in the range of 100 μl to 2,500 μl. In addition to its volumetric range, the microvolumeter 7 is to have the characteristics of an effective self-washing for making possible the alternation of products without contamination of the products followed by the preceding. The embodiment that is illustrated in FIG. 3 makes it possible to reach these objectives.

This microvolumeter is to make possible the precise measurement of a given volume and that, completely independent of the nature of the liquid (viscosity), of the inherent characteristics of the pump 4 and the ambient temperature.

According to a first practical embodiment shown in FIG. 3A, said microvolumeter 7 primarily consists of a glass tube 9 with an outside diameter on the order of 8 mm. The diameter of the inside channel is 6 mm. The lower part of the tube is reduced in diameter by 2 mm.

The upper part of the tube 9 is surmounted by a "T"-shaped block 16 whose lower part is connected, in an airtight way by means of an O-ring seal 17, to the upper support surface of the tube.

The channel that is opposite with this connection makes possible the introduction of products into the glass tube of the intake pipe 11. This pipe has an inside diameter of 0.8 mm. Its outside diameter is 1.6 mm.

A side channel that makes possible the introduction of a second pipe 13 (0.8/1.6 mm) into the glass tube is located at 90° of the primary channel, and the function of said side channel is, on the one hand, to ensure the expansion of the volumeter during its filling by liquid, and, on the other hand, to be used as a drain channel during the washing cycle of the microvolumeter.

The pipes 11 and 13 have a diameter that is reduced as much as possible for the purpose of having minimum surface area for contamination.

FIG. 3A illustrates the microvolumeter 7 with its intake valve 12, its expansion valve 14, as well as the product discharge valve 15'. The arrangement of each of the two pipes 11 and 13, which are introduced into the upper part of the microvolumeter, is important for correctly ensuring the objectives of precision in measuring and washing.

The intake pipe 11 of the products is curved (at 11') so that its outlet opening touches the inside wall of the glass tube 9. Thus, the energy of the liquid is broken, and the product flows in a laminar stream along the wall.

This method of flow minimizes the disruptions on the surface of the liquid during filling. Thus, the detection of the meniscus, geometry of the liquid/air separation surface, will be detected, without turbulence, by the optoelectronic device of the torque [infrared light emitter 10'/light receiver 10"]. This unit 10 comes in the form of a fork whose separation between the two strands is equal to the diameter of the glass tube.

When the liquid reaches the height of the transverse light beam, the latter is deflected by the diopter that is formed by the liquid-air concave surface. The intensity of light received by the receiver 10" decreases, and this shaped signal closes the intake valve 12 of the volumeter.

Thus, by moving the position of the detector 10 along the glass tube 9, it is possible to adjust its filling level precisely. It can thus be adjusted to provide 1 ml of product at the outlet of the unit of the fluid distribution circuit that goes from the outlet of the product valve 19 (A to H) to the surface of the volumetric meniscus. Thus, the inside of the micropump 4 is taken into account.

During the filling of the microvolumeter 7, the expansion valve 14 is open. Thus, as liquid is introduced, air is expelled. The expansion pipe 13 is placed, as is illustrated in FIG. 3. This position, as high as possible, will make possible complete and effective washing of the volumetric measuring device 7.

For the cleaning of the microvolumeter 7, two cycles are considered, namely:

The washing of the distribution circuit:

The outlet valve 15' is closed. The expansion valve 14 is open. 1 ml of cleaning water is introduced into the circuit. The liquid stays for one second during which an exchange, by diffusion, makes it possible to dilute the product residues adsorbed by the walls. Liquid is then expelled into the container 18 by the introduction of pressurized air in the circuit by opening the air valve v6. During this operation, the expansion valve 14 is closed. Three cycles that are identical to the one described above are carried out.

The washing of the microvolumeter:

The outlet valve 15' is closed. 2 ml of cleaning water is introduced via the intake valve 12. The volumetric excess then flows through the expansion valve 14 that is used as a valve for washing the microvolumeter 7 and itself also dumps into the beaker (container 18). A rest time of one second makes possible an exchange between the liquid and the wall. Air is next introduced under pressure for purging the microvolumeter. Three identical cycles are then performed.

The unit that is formed by the microvolumeter 7 and its fluid circuit 3 is then suitable for letting in, without contamination, another product.

The structure variant of the volumeter 7, shown in FIG. 3B, associated with the second embodiment of the device 1 shown in FIG. 1B, is inspired by that of FIG. 3A, while having a type of detection of the level in the tubular container 9 and a method for filling and draining the latter that are different, as already indicated above.

The connection of the tubes or pipes of the intake lines 34 and air injection lines 34' is carried out by means of an upper plug 16, and the connection of the tubes or pipes of the supply line 3, 11 and drain line 15 is made by means of a lower plug 16', with implementation of a T-shaped connection.

The operation of the volumeter 7 of FIG. 3B can be summarized as follows:

Filling of the volumeter

The valves 35 and 35' are at rest (position 1); the volumeter 7 is in uptake mode The outlet valve 15' is closed The valve 11 for intake of liquid products is open The pump 4 is activated (air pump or vacuum pump)

Liquid is sucked into the tube 9 and the float 33 rises until its upper level intersects the optical beam of the detector 10

The valve 11 for intake of liquids is closed, and the pump 4 is stopped

The level of liquid introduced is then that of the volume occupied by the liquid-disk unit 33, from which it is necessary to deduce that of the float 33. Thus, it is sufficient to adjust the position of the detector to adjust the desired volume of liquid.

Draining of the volumeter

The valves 35 and 35' are in active position (position 2)

The outlet valve 15 is open

The pump 4 is activated

The air pressure empties the volumeter 7 of its contents

The valves 35 and 35' are stopped (position 1)

The outlet valve 15 is closed.

Besides its operation, the microvolumeter 7 is also a safety and alarm element. Actually, the time reserved for the detection of the filling of the volumeter for reaching the detection level (1 ml) can be limited to 10 seconds by in-factory programming. This time is calculated to satisfy the volumetric detection of the most viscous products. If the level is not reached at the end of 10 seconds, the apparatus then stops immediately. The program is interrupted, and a filling error message is delivered. This message indicates the name of the product that could not be measured. This defect can have two origins: organic defect of the fluid chain or more probably that the container of said product is empty. Thus, the microvolumeter 7 is also a true functional safety and alarm element.

Taking into account the diversity of shape, volume and size that are possible for the containers or tanks 2 of products or active substances, when the latter are not standardized, the connection between the fluid circuit of the device or the apparatus 1 and these containers can prove problematic.

To be able to ensure a tight connection despite this problem, the invention proposes, as already indicated above, a type of universal connection that makes it possible to favorably respond to the heterogeneity of situations encountered (primarily rings or collars with a diameter of 21 mm or 48 mm for the products targeted).

Two solutions are proposed as illustrated in FIGS. 4A and 4B.

FIG. 4A shows a polyvalent connecting means 23 in the form of a plug 23' with two stages of a truncated cone whose diameters are different. In this case alone, two stages are necessary to cover the range of needs. It is possible, however, to imagine producing universal plugs with three or four stages so as to satisfy a larger range of needs. With the limit being provided by the acceptable length of the plug 23', it is possible to imagine ranges that are covered.

FIG. 4B of the drawings illustrates a second version of a universal plug in the form of a plug with multiple stages, in line with a pulley with stages. To satisfy the needs, the diameter of each stage is in accordance with the standards required (Ø21 to Ø48). To perfect the lateral seal, the vertical wall of each stage can also be slightly conical and centered on the normalized diameter.

As FIGS. 4 and 5 show, a central channel passes through each plug 23', and a sheath, a rigid tube for guiding and protecting the air intake pipes 24' and for extraction of product 24 and optionally a third tube for atmospheric pressurization of the container 2 are inserted into said central channel.

The air pipe 24', with a fluid connection to the air injection pump 21 (for example, an aquarium pump), is terminated by a filter 24" that generates air bubbles. The latter will stir the liquid medium so as to make it homogeneous.

As FIGS. 4A and 5A of the drawings show, by way of example, the second pipe 24, also of small diameter (1.6/08), can also be terminated by a filter 24" whose object is to block the large particles (aggregates of undiluted product) so as not to obstruct the fluid circuit, pipes, valves and micro-volumeter.

Consistent with a variant embodiment shown in FIG. 5B, the connecting means 23 can be equipped with a filtering means 39 for the substance to be extracted that is located outside of the container 2 in question and connects in an interchangeable manner in line with the conduit 24' for intake of the concentrated liquid. This filtering means 39 comprises a transparent body 39' that forms a housing and that contains the filtering body 39" through which the substance to be filtered passes, with the filtrate being visible from the outside (visual examination of the quality of the filtrate, the degree of smearing of the filtering body 39", and the presence of aggregates or crystals).

In the case of blocking the filtering body 39" (in particular after an extended period of not sampling the substance of the container 2 being considered), a reversal of the impulse flow can be considered for the purpose of unblocking.

A third tube optionally can be inserted to put the flask under ambient atmospheric pressure.

Two cable tighteners mechanically attach the pipes 24 and 24' to the sheath and prevent any sliding. It is possible to complete the mechanical attachment of the tubes by the silicone seal running into the gaps. It will be necessary in this case to pass a third tube to put the container under atmospheric pressure so that it does not become deformed as its contents are extracted by the intake micropump 4.

The tanks or flasks 2 can, based on the sizing of the device 1 and the type of use (by a private individual, by a professional craftsperson, etc.), have varied volumes.

For a given type of plants and/or given development phase, it can be envisaged to provide a set or kit of flasks 1 of limited volumes, suitable for the given situation or for the targeted phase of development of the plants, as described above.

The second module 29, which forms the complementary part of the device 1 according to the invention, is illustrated diagrammatically and by way of example in FIG. 2B.

The module 29 primarily consists of an upper housing 29' into which are placed two air pumps 21 that blow air bubbles into the flasks or tanks 2 so as to homogenize the products before each sampling, as well as a support plate that receives the tanks or flasks 2 of concentrated and liquid products for distribution and for washing.

The two modules 27 and 29 that form the device 1, namely the machine for preparation and support of the flasks that are produced, are advantageously supplied at a low voltage of 24 volts. An electronic interface, installed in the upper housing of the support of product flasks, produces the 220 alternating volts (50 hertz) that are necessary for the supply of the two pumps 21. The lower part of the support consists of two slightly sloped plates for making possible the pumping of maximum liquid. The supports shown in FIG. 2B can collect eight flasks of different products 2 and a washing water container 2'.

The device 1 according to the invention can come, based on the desires and aptitudes of the user, in the form of a universal apparatus or a specific apparatus, as FIG. 1D illustrates.

In its universal apparatus version, the device 1 can sample the active substances from any containers 2 and according to any initial formulations, with these active substances being able to be used for successive phases of development and evolution of the plants to be treated. The circulation lines of liquids and the structure of the selection/distribution means (with or without a second valve block 22, with or without 3/2 valves 36) are then adapted to the use being considered and to the characteristics of products.

In its specific apparatus version, the device 1 is fed by active substances that are packaged and metered by nature and by volume.

In this case, the individual and varied flasks (size, shape, volume, nature, brand) are replaced by packs 2" of products that are packaged and metered by nature and by volume to satisfy one of the three phases "root," "growth," "flowering/fruit-bearing" of the development of a plant organism, this in combination with specific programs recommended by the suppliers of nutrients.

Consistent with the version of device 1 that is adopted and the effective final use, various control methods can be considered, which may or may not implement a separate programmable support, namely:

The manual mode,

The "product supplier program" mode,

The "warned user program" mode.

The manual mode involves managing and programming manually, by means of specifically assigned buttons 31, each of the stages of a user execution program: management of successive products by nature and by amount, final volume of the product to be prepared, etc.

In addition, this mode makes it possible to access all of the operations for washing lines of products (A to E paths).

In the "supplier program" mode, the user has access to standard programs recommended by the primary suppliers of liquid biological nutrients. This mode may correspond to the primary mode of a device 1 that is dedicated to a single supplier of a range of products for plants.

In the "informed user program" mode, the protocols, created by the users, are acquired on a personal computer from a specific application provided with the device 1.

Its use is simple and didactic. It makes it possible to create a la carte programs by informed users who are competent in maintaining and tracking a quality plant environment. Several standard programs are resident programs to facilitate training.

By way of example, an application program can be called "crop." At the base, there can exist 20 crops free of any element. Each crop can be designed by its user by a name that is specific thereto, for example: "standard growth" or "standard flowering" or "growth+," etc.

A "crop" can, for example, come in the form of a grid with columns and lines and can have the following characteristics and properties, relative to the following programming method:

1. The columns represent the weeks of 7 days. A program can be spread over a maximum of 20 weeks. In a standard way, a given phase, growth or flowering, does not exceed 7 to 8 weeks.

2. The lines from A to F are assigned to products.

3. When the user points the arrow of the mouse on the first line of the numbers of columns and clicks once, a calendar appears.

4. It thus is possible to select in the calendar the date of the first day of the week where the crop will begin. By default, the calendar displays the current date. Then, all the user has to do is to click on a sync to make the date on which the program will start appear in green above the first column.

5. Thus, the program is always in relative mode, modulo 7 days of a week, and it can begin regardless of the actual day of the week.

6. To program the last week of execution of the program, all that has to be done is to position the pointer of the mouse at the number of the desired week, to click to open the calendar and to click to the end, in red at the bottom of the calendar. The final date appears above the last week of the program.

7. Then, all that has to be done is to record the program on the microcard Sd. It also records automatically on the hard disk of the computer, and it can then be found in the "crops" file.

8. Then, all that has to be done is to remove, according to the rules, the microcard Sd from the computer to transfer it to the device 1.

9. The microcard is then introduced into its housing and the program files, written on the microcard, are accessible by the "RUN" menu displayed on the screen of device 1.

10. Then, all the user has to do is to select "Sd" and to scroll, by pressing the advance arrow, the desired program and to validate it.

11. The device 1 then provides all of the elements of the registered program. Thus, it is easy for the user to verify each of the components by following the guide proposed by the apparatus.

12. After having selected the desired program, the device 1 makes the gap appear between the day programmed for the beginning of the first week and the current day, for example: week 01, day 01. This means that the first day of the first week is the current day. If, for example, the first day of the first was programmed for January $5^{th}$ and the program was launched on January 6, the display would appear: week 1, day 02, and so on for each day and each week.

13. When the user wants to launch the program on a date subsequent to the date that corresponds to the last day of the last week of the program, the device 1 will display "terminated program."

Thus, the device 1 is not limited by number and by nature of programs of execution but remains open and adaptable based on the needs and the evolution of the products.

It is easily understood, from reading the present, that the invention makes it possible for private individuals, such as enthusiasts, to use and to enjoy a quality plant environment without having to undergo either limitations or constraints and without being a specialist therein.

The device 1 automatically delivers all of the products that are metered and diluted to satisfy the three essential stages of development of roots, plant growth, flowering, and/or fruit-bearing of the various and varied plants.

Of course, the invention is not limited to the embodiments described and shown in the accompanying drawings. Modifications are possible, in particular from the standpoint of the structure of various elements or by substitution of equivalent techniques, without thereby exceeding the field of protection of the invention.

The invention claimed is:

1. An automatic or semi-automatic device for controlled metering and mixing of concentrated substances, said device comprising;

a sampling means operatively connected to each of plural tanks (2) that respectively contain one of the concentrated substances, each of the concentrated substances being a plant nutritional substance or a plant fertilizing substance, the sampling means for selective, individual sampling of the concentrated substances in the respective tanks, transfer means for fluid transfer, said transfer means comprising at least one fluid circulation line (3) operatively connected to each of the plural tanks and to at least one active element for movement of liquid (4) as sampled concentrated liquid, valve means (12, 14, 15', 19) for controlling circulation of fluids in the device, a dilution means that provides a dilution liquid, a measuring container (18) that receives the dilution liquid and the sampled concentrated substance(s), measuring means comprising i) an elementary measuring means (7) comprised of a container (9) connected to receive the sampled concentrated liquid via the transfer means, the elementary measuring means (7) sequentially dosing successively basic volumes of the received sampled concentrated liquid within the container (9), the container (9) emptying into the measuring container (18) for at least one of subsequent mixing and subsequent dilution by receiving the dilution liquid from the dilution means, to thereby obtain an amount of final solution, and ii) at least one determining means (8) for determining the amount of the final solution in the measuring container (18), and a control and management unit (5) for controlling the sampling means, the transfer means, the elementary measuring means (7), the determining means (8), and the valve means.

2. The device according to claim 1, wherein the elementary measuring means (7) comprises a volumetric measuring means with optical detection, wherein the container (9) is a calibrated tubular container (9) made of a transparent material, equipped with a level optoelectronic detector (10) and supply and drainage means (11, 11', 12, 13, 14, 15, 15', 16, 16').

3. The device according to claim 2, wherein the optoelectronic detector (10) is an infrared detector that comprises an emitter (10') and a receiver (10") located on either side of said tubular container (9), with an axial location corresponding to the basic volume of the received sampled concentrated liquid, and with said detector (10) detecting a presence of a meniscus between the emitter (10') and receiver (10").

4. The device according to claim 2, wherein, the supply means comprises i) a first tube or pipe (11) connected to the at least one fluid circulation line (3) for circulation of the fluid from the fluid transfer means by an inlet control valve (12) having an outlet (11') in contact with a side wall of the tubular container (9) , in an upper part of the tubular container (9), above the optoelectronic detector (10), and ii) a second tube or pipe (13) that empties at an upper end of the tubular container (9) and that is connectable by means of a corresponding valve (14), selectively to a washing liquid tank (2') or to the atmosphere, with liquids being displaced in a controlled manner under action of the at least one active element (4), by suction and transfer of said concentrated substances through said at least one active element.

5. The device according claim 2, wherein the optoelectrical detector (10) forms a light barrier and comprises an emitter (10') and a receiver (10") located on either side of said tubular container (9), with an axial location corresponding to the basic volume of the received sampled concentrated liquid, and wherein said container (9) contains a float body (33), a cylinder, or a disk that is free in movement, in the axial direction of the tubular container (9), and that is detectable by the level optoelectronic detector (10).

6. The device according to claim 5, wherein the float body (33) comprises a non-woven disk, having on an outside periphery, a threaded structure or pattern (33') that is made of a chemically neutral material relative to the sampled concentrated liquid.

7. The device according to claim 2, wherein the movement of the liquid (4) by the at least one active element is done by suction under action of underpressure generated in said container (9) by the at least one active element (4), and draining from said container (9) being accomplished by aeration or pressurization of the container.

8. The device according to claim 5, wherein the supply means comprise i) a first tube or pipe (11) that is part of the at least one fluid circulation line (3), the first pipe having a fluid connection to the lower part of the tubular container (9), and ii) lines for intake (34) and injection (34') under air pressure having a fluid connection to the upper part of the container (9), above the optoelectronic detector (10), with the suction and the injection being performed under action of the at least one active element (4).

9. The device according to claim 8, wherein, the first pipe (11) and the second pipe (13) are made integral mechanically and connected in an airtight way to said container (9), and an outlet valve (15') is associated with the drain line (15), the outlet valve having a fluid connection to the lower end of the container (9).

10. The device according to claim 8, wherein the tubular container (9) comprises a portion of transparent tube with a calibrated inside volume, mounted with a vertical arrangement in a support body (9') that also has the optoelectronic detector (10), wherein parts (16, 16') forming plugs are connected in an airtight manner to the upper and lower opposite ends of the tubular container (9) by being made integral with the support body (9'), and wherein each plug (16, 16') comprises a stud (16") comprising, on the one hand, a base (16''') on which the corresponding end of the tube portion forming the container (9) interlocks with flattening of an external seal (17), and, on the other hand, a head (16'''') extending in a limited manner into said tube portion (9) and having a seal (17') that is applied against the inside surface of said tube portion (9), a conduit emptying into the inside of said container (9) passing through each stud (16") and having a fluid connection respectively, at the plug (16, 16') in question, either to air intake/injection lines (34, 34') or to a tube or pipe (11) that is part of the line (3) for circulation of fluids of the fluid transfer means and to a drain line (15), with insertion of an intake control valve (12) and a corresponding outlet control (15).

11. The device according to claim 1, wherein the determining means (8) comprises an electronic device for weight/volume conversion.

12. The device according to claim 1, wherein the sampling means comprise, for each said tank (2) a valve (19) with a very low dead volume, wherein a unit (19") of the valves (19) is cascade-assembled and mutually interconnected at their outlets by a single collecting and distributing channel (19') to form a multi-path distribution unit (19') and wherein bodies of the valves (19) form the multi-path distribution unit (19") are made in a single block of material (20), in which the collecting and distributing channel (19') is also arranged.

13. The device according to claim 12, wherein the multi-path distribution unit (19") also comprises a valve (19) whose inlet is connected to a washing and dilution liquid tank (2') and a valve (19) whose inlet is connected to the atmosphere, whereby the two valves (19) are located respectively in the front-back and in the last position relative to the outlet (20') of the collecting and distributing channel (19') in the arrangement of valves (19) connected successively to said channel (19').

14. The device according to claim 12, wherein the sampling means comprise at least a second multi-path distribution unit (22), formed by at least a second cascade-assembled valve unit (19), mutually interconnected at their outlets by a collecting and distributing channel (19') and whose valve bodies are also made in a single material block (20), the outlet (20') of the collecting and distributing channel (19') of this second unit (22) of valves (19) advantageously being connected to the collecting and distributing channel (19') of the first unit (19") of valves (19), preferably between the outlet (20') of this last channel (19') and the first valve (19) of the valve arrangement forming said first unit (19") of valves.

15. The device according to claim 12, wherein the transfer means and the supply means comprise, between the selective sampling means (19, 19') and the elementary measuring means (7), a fluid switching means (36), of which a first inlet is connected to the outlet of the collecting channel (19') of the selective sampling means (19, 19'), of which a second inlet is connected either to a container (2), or to a second multi-path distribution unit (22), and of which the outlet is connected, by a tube or pipe (11), to the inlet of the calibrated tubular container (9) of the basic elementary measuring means (7).

16. The device according claim 1, wherein the sampling means comprise, for each said tank (2) a polyvalent and multifunctional connecting means (23) constituted by a structural body (23') forming a universal plug and through which a first tube (24') supplied with bubbling gas, preferably pressurized air, passes and through which a second tube (24) for the intake of the liquid that is contained in the tank (2) in question passes.

17. The device according to claim 16, wherein the structural body (23') comprises a hollow body of a shape that is elongated and tapered in the direction of the an end that is introduced into the tank (2) being considered and comprises means (25) for support and holding of the two tubes (24 and 24') that pass through the structural body, with the ends of the two tubes being provided with filters (24").

18. The device according to claim 17, wherein the structural body (23') comprises two contiguous truncated parts (26, 26') that have angles with different peaks.

19. The device according to claim 17, wherein the structural body (23') has an overall truncated outside shape with a stepped structure.

20. The device according claim 1, wherein the respective tanks (2) of concentrated substances are each a unit of cartridge containers, with the concentrated substances of the containers (2) being metered by nature and by volume, with receiving sites of said containers (2) being provided with means for automatic recognition of characteristics of the containers (2).

21. The device according to claim 1, further comprising a means (32) for selective distribution of the concentrated liquids sampled in the containers (2) and quantified by the elementary measuring means (7) in the form of a unit of cascade-assembled valves (19) that are mutually interconnected at their inlets by a single supply channel (19'), with a fluid connection to the outlet of the elementary measuring means (7) and wherein a means for determining the metered solution obtained by dilution is associated with each outlet of valve (19), sequentially in separate containers or in a continuous manner by injection in one or more circulating liquid stream(s).

22. The device according to claim 1, further comprising two modules (27, 29) that are connected to one another, namely:

a first module (27) in the form of a box (27) with a C-shaped structure with a first lower part (28) forming a base and containing the determining means (8) in the form of an electronic scale, a second median part (28') forming a structural upright and containing the at least one active element (4), with the elementary measuring means (7) and the valve units (19", 22) forming part of the selective sampling and transfer means, a wing-shaped third upper part (28") located at a distance above the base (28), having a communicating and programming interface (6) and containing the control and management unit (5), a first part of the fluid and selective sampling transfer means thus being distributed between the second and third parts (28', 28"), and a second module (29) in the form of a support or a box for storage with receiving sites for the tanks (2, 2'), comprising an upper box or cover (29') integrating a complementary part (3, 23) of the sampling and transfer means, as well as means (21) for homogenization by bubbling of liquids that are present in said tanks (2, 2').

23. The device according to claim 22, wherein the first module (27) is provided with, relative to the control and management unit (5), at least one reader (37) of programmable-memory media, and wherein the communication and programming interface (6) comprises light signaling lamps (38) indicating at least operating phases in progress or malfunctions.

24. The device according to claim 1, having a functional modular structure, with functional components physically being composed in the form of separate material blocks, including a transfer block integrating the at least one active element (4), an electronic block integrating the control and management unit (5), a measuring block integrating the elementary measuring means (7), a selector/distributor fluid block comprising one or more blocks of valves (19, 12, 14, 15') and a weight/volume conversion block integrating the determining means (8).

* * * * *